United States Patent [19]

Lewandowski

[11] Patent Number: 4,865,178

[45] Date of Patent: Sep. 12, 1989

[54] SINGLE COPY VENDING MACHINE FOR NEWSPAPERS AND THE LIKE

[75] Inventor: Frank S. Lewandowski, Chicago, Ill.

[73] Assignee: Lew Enterprises, Inc., Bessemer, Mich.

[21] Appl. No.: 63,527

[22] Filed: Jun. 18, 1987

[51] Int. Cl.[4] ..... B65H 3/22

[52] U.S. Cl. ..... 194/227; 194/346; 221/213; 221/20; 221/227; 221/232

[58] Field of Search ..... 221/17–20, 221/213, 232, 227, 228, 236, 238, 247, 248, 262, 268, 269; 194/351, 226, 227, 346

[56] References Cited

U.S. PATENT DOCUMENTS

| | | | |
|---|---|---|---|
| 1,310,826 | 7/1919 | Grover | 194/351 |
| 1,622,262 | 3/1925 | Kindrat et al. | 221/232 X |
| 3,062,406 | 11/1962 | Kent et al. | 221/232 X |
| 4,413,749 | 11/1983 | Glaser | 221/213 X |
| 4,592,461 | 6/1986 | Friedman et al. | 194/227 |
| 4,747,478 | 5/1988 | Friedman et al. | 194/227 |

OTHER PUBLICATIONS

Berkley Small (Medina, Ohio) "Newsvendone" brochure (undated).

Kasper Wire Work, Inc. (Shiner, Texas) "Show-Rack" brochure (undated).

SCS Simplified Credit System, Arts Lists, 13–03 Series, Mechanical Accumulator, assembly view and parts list, dated as revised 12–12–78.

Johnson Rack, Inc., Service Manual, "Little Merchant", Model JJ-1-82.

*Primary Examiner*—Joseph J. Rolla

*Assistant Examiner*—Steven B. Parker

*Attorney, Agent, or Firm*—Lee & Smith

[57] ABSTRACT

A vending machine for dispensing single copies of newspapers or the like by the operation of a pull and push handle that is linked to a plate carrying needles that draw one copy of a newspaper outwardly from a tray through a dispensing door. The newspapers are carried on a spring biased tray that advances newspapers upwardly. The tray is controlled by a brake lock mechanism that allows the tray to be moved upward to a sufficient distance relative to the dispensing door so that only a single copy is drawn outwardly and wherein the brake lock locks the tray at the same respective vertical location for the next paper to be dispensed. A safety ratchet mechanism is arranged with a cable pulley system that is driven by a tension spring arrangement whereby the delivery person may load incremental amounts of newspapers on the tray and safely advance the tray downwardly against the spring loading. The apparatus further includes an anti-theft inner trap door that is unlocked during the operation of the pull and push handle to be spring biased upwardly against the under surface of a newspaper so that a thief can not reach into the housing of the vending machine and take more than one edition of the newspaper. A coin deflector mechanism is provided so that upon dispensing the last newspaper a plurality of fingers are made to pivot into the coin slots of a coin acceptor mechanism to deflect them into the return slot and back to the customer. A price switch-over assembly is provided so that the apparatus may be set to vend papers of different prices.

1 Claim, 7 Drawing Sheets

Fig. 5.
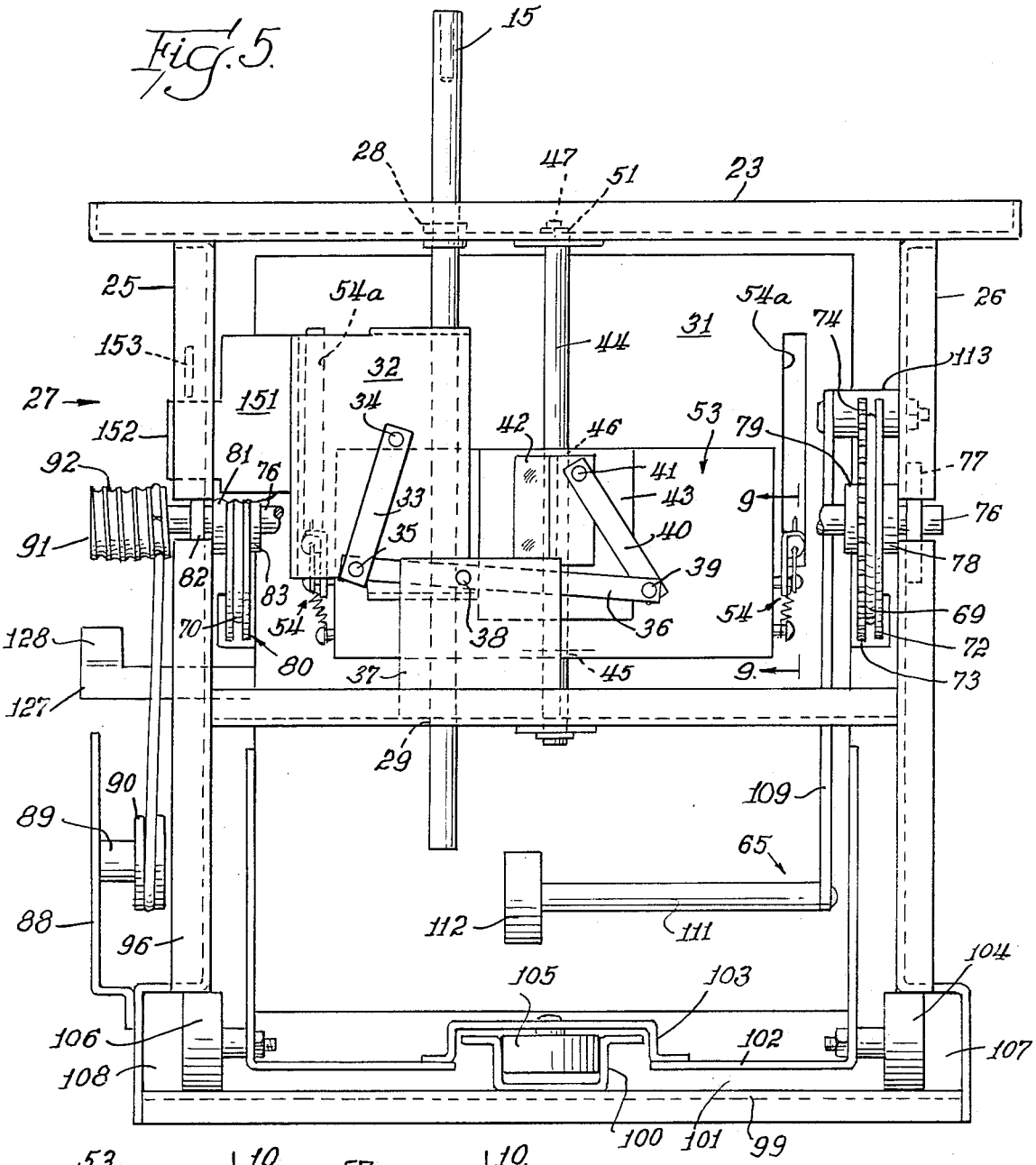
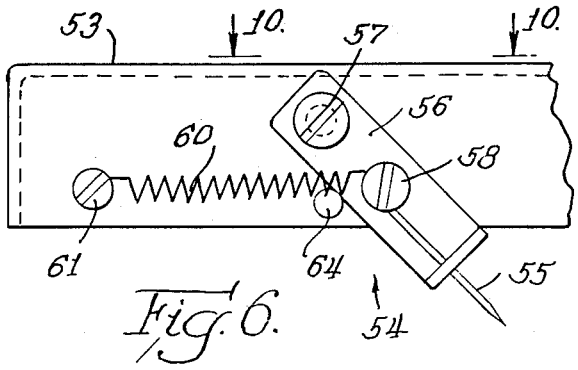
Fig. 6.
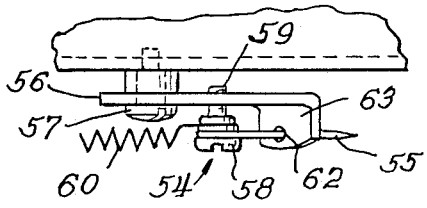
Fig. 7.

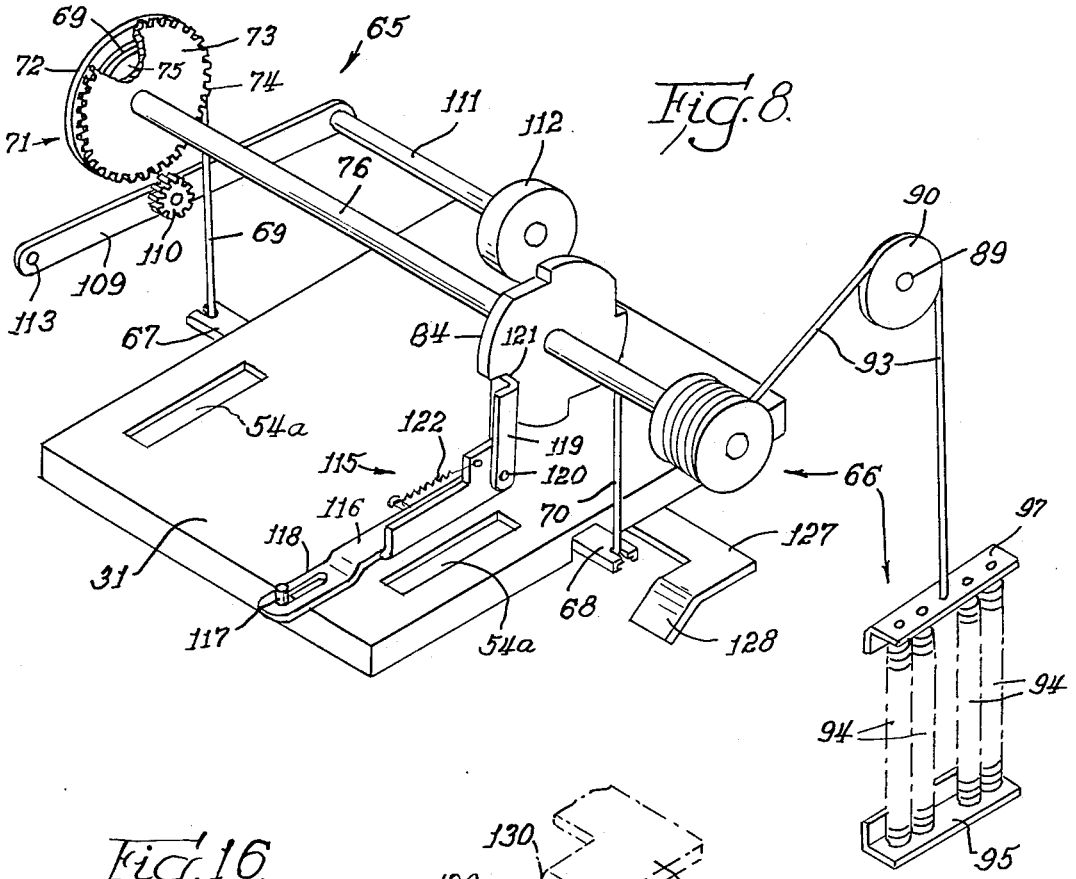
Fig. 8.
Fig. 16.
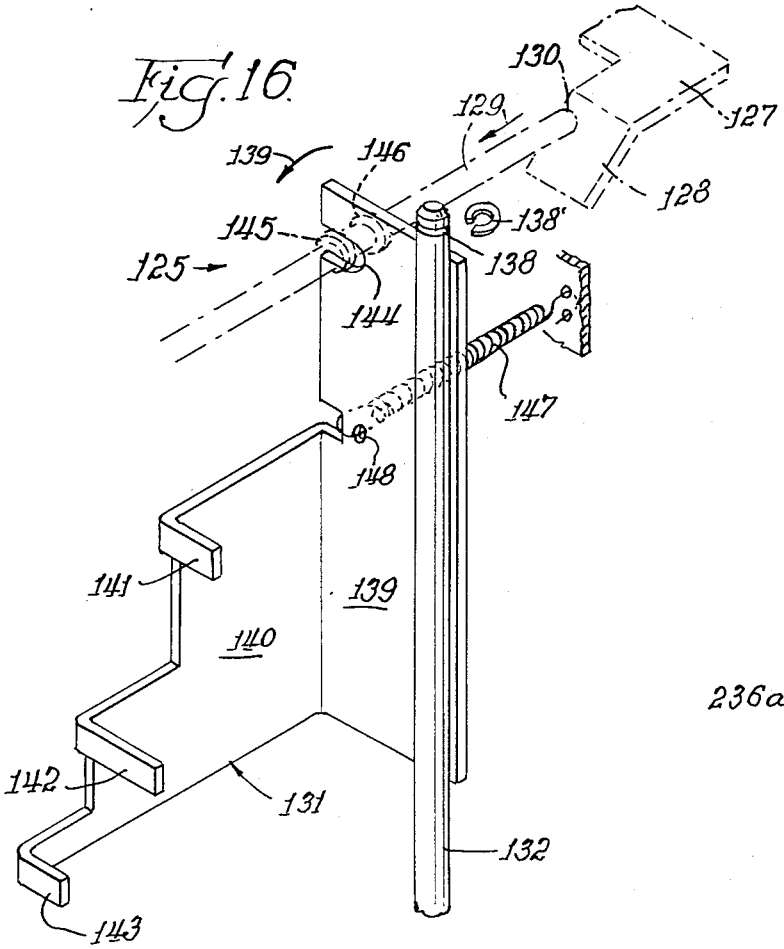
Fig. 20.
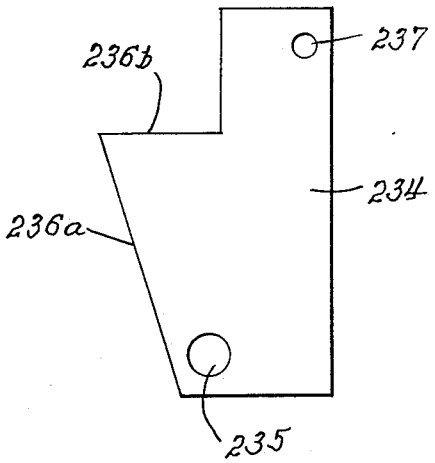

153
154
180
COIN INSERT CHUTE
179
155
155'
157
COIN ACCEPTOR
181
178
177
173
175
135
137
174
176
129
150
161
158
162
160
159
168
149
196
195
147
164
199
194
191
192
193
198
197
208
204
202
200
203
201
206
205
150
207
189
186
211
190
183
132
185
136
184
134
182
155"
187
209
133
126
COIN TOTALIZER 12
17
16
215
218
219
224
233
123
238
234
191
217
226
225
227
229
235
221
216
232
201
231
220
222
223
124

226
225
230
228
229

226
227
228
229

SINGLE COPY VENDING MACHINE FOR NEWSPAPERS AND THE LIKE

BACKGROUND AND SUMMARY OF THE INVENTION

The invention relates generally to vending machines and particularly to those directed to dispensing newspapers to customers who deposit the appropriate combination of coins. More specifically, the invention is directed to dispensing single copies of newspapers and the like.

Vending machines are widely known to the public for almost every kind of merchandise, food and beverage imaginable. Dispensers for various articles are well known in which the customer inserts coins into a slot or channel and either by electrical apparatus, or a mechanical totalizer, counting the change an article is dispensed. Usually packaged items, beverage cans, and the like, can be dispensed one at a time from racks inside a machine and devices accomplishing this end are well known in the art. Heretofore however, vending machines capable of dispensing a single copy of a newspaper, or other flat-type publications, require manual adjustments for dispensing different sized newspapers and are not self-adjusting.

An outmoded lock box with a swing out door is the usual and predominant type of newspaper vending device that the consumer encounters at street corners, train stations, airport terminals, lobbies of buildings and an infinite number of other environments. Typically the newspaper reader deposits the appropriate amount of coins, such as twenty-five cents for a daily paper, and a mechanical door lock is disengaged so that the customer may swing the unlocked door open, reach into the receptacle or box, and extract a paper. With these devices, the honor system is required. Obviously, the unscrupulous may fall prey to ulterior motives and accumulate more than one copy of the newspaper to sell for themselves. Such thievery results in financial loss to the newspaper distributor or newspaper truck driver, who buys papers at wholesale and is remunerated by collecting the coins held in a collection box within the vending device. The standard lock boxes are also subject to vandalism due to the easy access they provide.

Because of the expected loss of up to 20% to 40% in certain urban environments plagued by high crime rate, fewer copies of a newspaper are put into the present day vending boxes then they are capable of holding in order to reduce losses per box. The supply is usually sold quickly in the early morning hours. The honest consuming public is thereby cheated of the opportunity to have convenient access to newspapers at many locations.

The use of the conventional vending machines for newspapers magazines, publications, and the like, also inconveniently require the patron to open a door, stoop over, and then reach into the box to extract the newspaper. Compared with obtaining, for example, a can of carbonated beverage from a vending machine, or a package of cigarettes from a cigarette vending machine, the present day newspaper vending devices are anachronisms.

It would be desirable for the newspaper distributing industry to provide a vending machine that dispenses only a single copy of a newspaper, or other flattened-like, or folded, printed publications, at a time to the public in an easy-to-operate manner for the customer.

It is a related object of the invention to provide a single copy vending machine that is theft resistant.

It is further an allied goal of the invention to provide a single copy vending machine which may be quickly and safely loaded with a new supply of newspapers with an interior storage capacity that is significantly larger than the number of newspapers that conventional swingout door boxes can hold.

It is also an object to dispense the newspapers horizontally at a convenient height to the customer. In this regard it is desirable to provide a spring loaded tray interiorly of a housing forming the storage portion, onto which a full, heavy load of papers is held to be singly dispensed. It is therefore a concomitant objective to allow for intermittent stops during loading whereby the delivery person can safely lock the spring loaded tray at intermittent levels during loading for safety and ease of restocking the device with both hands free.

It is an important object of the invention to provide an easy pull-push handle means for dispensing a single copy of a newspaper upon the insertion of the correct number of coins into a coin accepter and totalizer device.

It is an allied goal of the invention to dispense the single copy of a newspaper outwardly of an access opening to the device for which an anti-theft means is associated in the form of a sliding inner trap door provided to prevent the theft and the subsequent loss of revenue caused by a thief gaining access to the storage portion.

It is also an object of the invention to provide a means cooperative with a conventional coin acceptor mechanism whereby to return any inserted coins to the customer when the device has been emptied of its last copy of the newspaper. It is a conjunctive goal to provide a linkage assembly system from the pull-push handle to the anti-theft mechanism and the coin loss prevention means as an overall system operated by the handle movement.

It is an important object of the invention to provide a brake lock mechanism for a spring loaded paper shelf, or product tray, that may advance copies of a newspaper into position for vending one at a time while locking the spring advancing means spaced at increments so that a next copy is appropriately positioned relative to an ejector mechanism to accommodate the size of the copy of the newspaper next to be dispensed. It is a closely related object to divise a self-adjusting brake mechanism which allows for the dispensing of a single copy of any thickness and wherein copies of various thicknesses may be vended from the device without modification whereby the brake lock mechanism self-adjusts to thickness differences.

It is a key goal of the invention to provide an ejector mechanism cooperative with a pull-push handle manipulated by the customer, which pulls a copy of the purchased newspaper outwardly of the vending device. It is a related object to provide an ejector mechanism which self-adjusts to surface variations and distortions common in a stack of newspapers whereby to accommodate such distortions and smoothly dispense copies with uneven arrangements.

To provide for the prevention of theft, it is an important goal to provide a door mechanism that is mechanically linked to the pull-push handle whereby to open a sliding trap door as the customer pulls the handle following insertion of the coins in order to permit the newspaper to be dispensed outwardly from the paper tray through a delivery slot through the housing for the device. Then, the trap door moves to abut a surface of the newspaper as it is pulled out by spring loaded means and, upon the full extension of the newspaper from the system, the door fully closes off the delivery slot. In a single copy vending system it would also be desirable to provide for means to quickly change the system to operate and vend differently priced newspapers, such as Sunday editions versus daily. It is accordingly an allied goal of the invention to provide for an adjustable linkage to a sensing assembly that associates with a mechanical coin totalizer interiorly of the device which senses the incremental advances of the totalizer and is linked to a locking mechanism for the pull-push handle. Of course, it would be desirable for the handle to not operate until the number of coins at the particular adjustment have been inserted then sensed by the sensing assembly at the totalizer and thus unlocking the system. It would be desirable to provide for the adjustment to the sensing assembly to unlock the handle at different coin amounts whereby the brake lock mechanism, ejector mechanism, anti-theft door, and coin accepting and totalizing system, are driven by the handle action as a single system when the correct number of coins are inserted and sensed by the sensing assembly.

All the foregoing objectives have been achieved and the problems in the prior art solved by the single copy vending machine invention disclosed herein. The invention may be summarized as comprising a spring loaded paper tray that is connected at pulleys by cables to a spring means, and wherein one cable takeup pulley assembly is provided with gear teeth for meshing with a brake gear on a pivoting brake arm so that the paper tray can be locked at incremental vertical advances for dispensing copies of newspapers one at a time. The brake arm is attached to a shaft carrying a wheel that senses the rear edge of a dispensing copy, then rolls off the trailing edge of the newspaper and lands on the surface of the next paper. The brake arm then pivots and unlocks the brake gear. The tray is urged upwardly to contact the wheel, pivot the brake arm and re-engage the brake gear to position the next copy ready to be dispensed, while preventing further upward advancement of the tray. A pull-push handle is linked to an ejector mechanism movably mounted on a shaft and including paper engaging means in the form of spring-held needles for piercing and then pulling a copy of a newspaper outwardly through an access slot in a housing for the system.

The pull-push handle is also linked to an actuator plate mechanically linked to a coin acceptor and totalizer mechanism, which is unlocked by the insertion of the correct amount of coins. The coins cause the rotation of a shaft of the acceptor which turns a cam means arranged therewith to a certain orientation detected by a vertical sensing member. The sensing member drops into a cam notch and unlocks a horizontal sensing arm carried by the actuator plate. The actuator plate is movably arranged with a dog and ratchet. The outward pull movement also drives a means for opening an inner anti-theft trap door so that upon subsequently pushing inwardly on the handle the ejecting means pulls out a copy of a newspaper past the opened anti-theft trap door and outwardly of the housing through a preferably hinged weatherproof door covering the access slot to be grasped by the reader.

The invention also includes a system for preventing the loss of coins when there are no more papers to be dispensed. Carried by the spring loaded paper tray is a coin lock bracket which moves upwardly to contact a coin deflector mechanism arranged with the coin acceptor. Upon reaching an elevation corresponding to dispensing the last newspaper, the coin lock bracket urges against a rod that is attached to a pivotally mounted and spring biased deflector plate which has fingers that are then moved into the coin slots of the coin acceptor, such as for nickles, dimes and quarters, and deflects them from the slots outwardly to the coin return slot so that the next customer is not cheated.

For ease of filling by the newspaper truck driver or distributor, a spring loaded lockout arm and lockout lever mechanism is arranged with a cable pulley at one side of the paper tray to engage ratchet-like teeth cut from pulley sideplates of a pulley wrap hub so that as the tray is moved downwardly during reloading the lockout arm engages at each ratchet location to prevent pulley rotation so that the tray does not dangerously snap upwardly and so that the tray may be moved downwardly in steps for loading a few of the newspapers at a time in order to allow the person to freely use both hands.

The lockout mechanism may be disengaged by the person pushing against the spring tension that holds the lockout lever against the ratchet teeth or by closure of the housing outer door which includes actuating means in positional correspondence with the lockout arm to push against the lockout arm and disengage the ratchet of the pulley side plates so that the wrap hub associating therebetween is freely rotatable due to the pressure of the paper tray springs that pull on the cable and spring load the tray for upward advancement of the system.

A pulley shaft connects opposing pulley wrap hubs-one being associated with the brake lock mechanism and the other with the safety lockout mechanism and each being associated with a cable that is connected to the shelf. Outward along the shaft from one of the opposing pulley wrap hubs a third cable wrap hub is provided for receiving cable thereover fed over a pulley sheave to connect to helical paper tray tension springs below which when are tensed as the tray is loaded downwardly and thus biases the tray toward upward advancement. The tray carries wheel means slidingly located in roller channels of a frame for the vending system for facilitating a smooth stable vertical tray movement.

The single copy vending system allows for adaption to an outer housing having the anti-theft trap door arranged at the inner side of hinged door that is unlocked by the newspaper distributing employee for loading the tray with the products and collection of the coins. The system allows for the accommodation of large numbers of newspapers since by virtue of the single dispensing capability the vendor may put greater numbers of copies into vending devices at locations which otherwise are subject to a high rate of theft. The actuator plate driven by the handle and the coin deflector means are mountable with conventional coin acceptors and totalizer mechanisms by the provision of a housing means formed to support the coin acceptor and totalizer therein and accommodate the actuator plate, coin sensing and unlocking means, and a movable shaft. The shaft passes inwardly of the housing to move a pivotable spring biased plate attached to the exterior of the coin acceptor and totalizer. The coin deflector plate includes coin deflector fingers arranged to extend inwardly of coin acceptor coin pathways so that when the coin deflector plate is pivoted the fingers rotated provide barriers to the normal pathways of the coins to deflect them to the return slot.

A cam means suitable for attachment to the rotating shaft of a coin totalizer is movably arranged with a vertical detector or sensing means so that when the appropriate number of coins are inserted the rotating shaft turns a cam notch to a predetermined position at which the vertical sensing means drops into the cam notch thereby unlocking a slide plate to be driven by the handle movement for operating the system to dispense a single newspaper.

BRIEF DESCRIPTION OF THE DRAWINGS

FIG. 5 is a plan view looking downwardly at the ejector system, spring loaded pulley system for the newspaper advancing tray, and the brake lock mechanism for controlling the advance of the tray and locking the tray after each dispensing of a newspaper to position the subsequent newspaper in engageable contact with the ejector system, which is operated by the pull-push handle means, and wherein the tray is supported by roller wheel means slidably arranged in vertical channels formed in frame portions of the vending machine interiorly of the housing;

FIG. 6 is a detailed side view of the needle holder assembly mounted on the ejector plate for piercing and pulling a newspaper from the product tray;

FIG. 7 is a top view of the needle holder assembly as shown in FIG. 6;

FIG. 8 is a diagrammatic perspective view of the spring loaded pulley system for advancing the product tray, a brake locking mechanism at one pulley for controlling the advancing of the tray, a safety lockout adjustment at ratchet notched side plates of a second pulley for limiting the upper movement of the tray during loading and further depicting a coin release bracket carried by the tray which trips a movable rod portion of a coin deflector mechanism upon dispensing the last newspaper on the product tray;

FIG. 16 is a perspective view of the coin deflector mechanism of the vending machine pivotally mountable to commercially available coin acceptor devices whereby to be pivotable by the sliding of a horizontal rod that is activated when a coin bracket of the product tray contacts and pushes against it when the last newspaper is dispensed to thereby block coin slots in the coin acceptor and prevent any further coins from being accepted while the product shelf is empty;

DETAILED DESCRIPTION OF PREFERRED EMBODIMENT

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the claims.

In the foregoing it will be appreciated that the single copy vending machine for newspapers and the like, generally referenced at 10, consists of a system of linked operations working in conjunction whereby an ejector means is operated by a pull-push handle to draw a newspaper out of a housing for the system and wherein a spring loaded advancing tray is controlled by a brake lock mechanism so that the upper surface of each sequential newspaper is caused to stop in the same elevational arrangement relative to an ejector means for pulling the newspaper outwardly of the housing. A linkage for the ejector means operates reciprocally and in opposite relative movement to the pull-push handle motion. The pull-push handle is locked until the appropriate number of coins are inserted to be counted by coin acceptor and totalizer mechanisms of conventional and known design. An extension flange, or tongue, is carried by a portion of the ejector means and is locked by a slide plate arranged with the coin acceptor device, which does not unlock until the appropriate number of coins are counted. An anti-theft inner sliding trap door is drivingly opened by the slide plate to push down a spring loaded slide door that closes adjacent an access opening in the housing through which the newspaper is horizontally delivered by an inward pushing stroke of the handle means. A coin deflector mechanism is also mounted with the coin acceptor and totalizing mechanism which is tripped to deflect coins from the coin slots into a return slot at a point in the operation when the paper tray, carrying a coin release bracket, contacts a push rod that pivots a coin deflector plate. The anti-theft door is spring loaded to bias upwardly against the bottom of a newspaper as it is horizontally expelled through a preferably hinged access door in an outer housing for the apparatus. The outer housing includes a large pivoting front loading door which is opened by the newspaper delivery person. The spring loaded tray is provided with a safety ratchet mechanism at one set of pulley side plates so that the tray is moved downwardly in incremental advances and caught at each ratchet catch so to prevent it from moving upwardly during loading to facilitate an easy controlled reloading of the tray.

Figure 1:
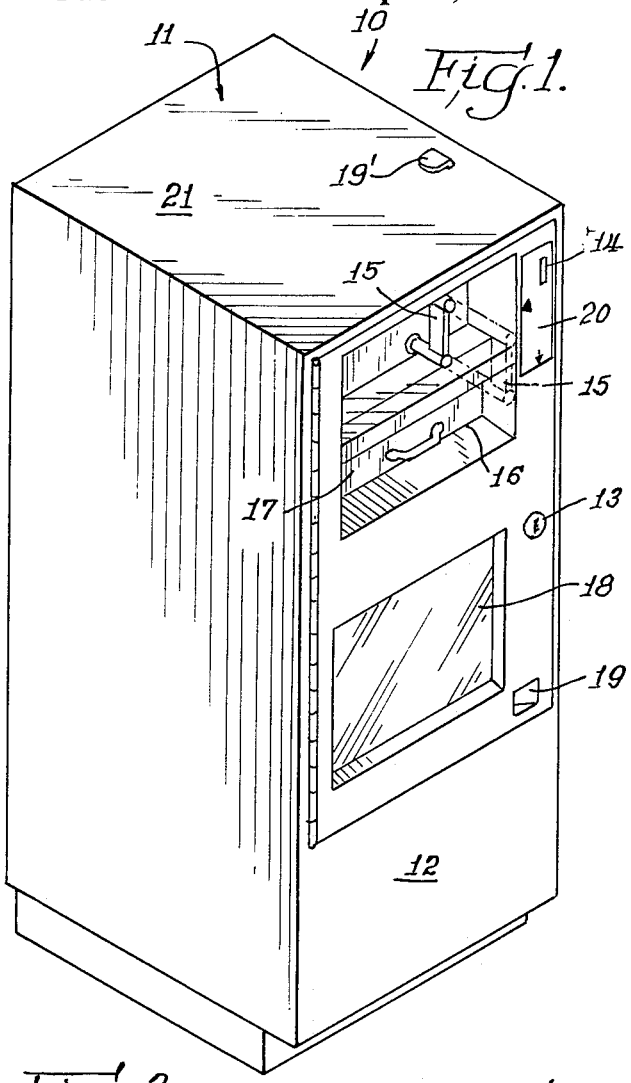
FIG. 1 is a perspective view of the vending machine showing the handle in the at-rest position and in phantom lines in a pulled position following the insertion of coins.
Figure 2:
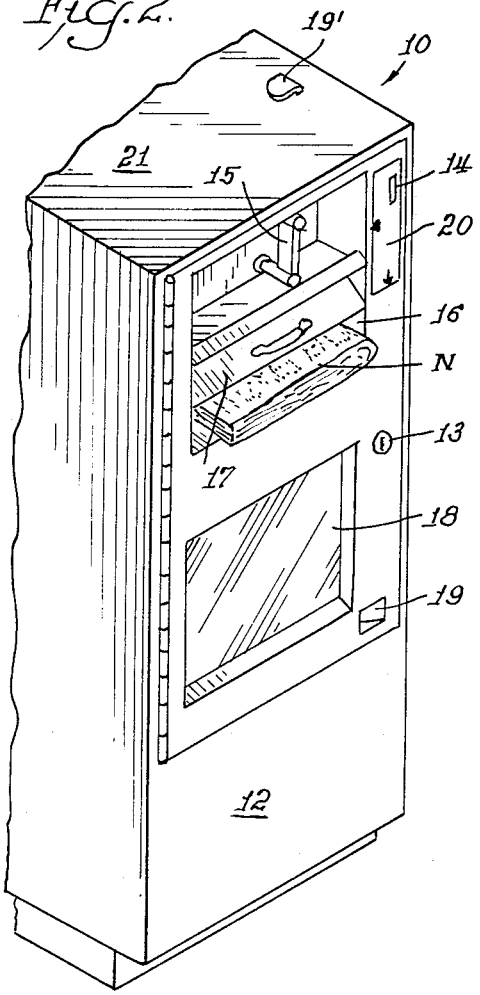
FIG. 2 illustrates the vending machine as in FIG. 1 but wherein the handle means is returned to its original position in a dispensing push stroke and showing a single copy of a newspaper being dispensed through the outlet door.
Figure 3:
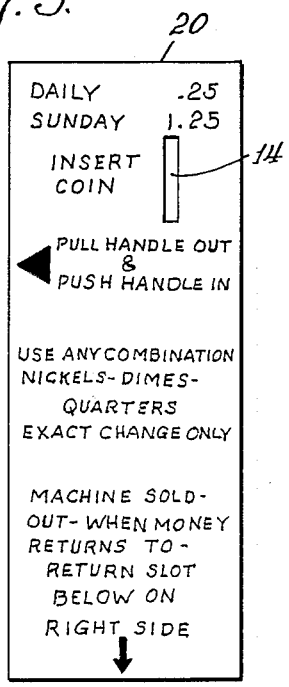
FIG. 3 shows an instructional panel and coin insert slot arranged in the upper right hand corner of the outward pivoting loading door of the machine shown in FIG. 1.

More specifically, and turning first to FIGS. 1, 2, and 3, the vending machine, or device, 10 is housed in an outer housing 11 having a hinged loading door 12 which is locked by a standard key lock mechanism generally at 13, which lock forms no part of the invention. A coin insert slot 14 is provided at the upper right hand corner of the housing 11 which is the initiation point for the operation of the system as the customer enters the appropriate correct value of coins, such as two dimes and a nickel for the usual daily twenty-five cent newspaper. As will be explained below, the insertion of the appropriate number of coins unlocks the driving member of the machine 10 which is a pull-push handle means 15 as illustrated in FIGS. 1 and 2.

Following the insertion of the appropriate number of coins into slot 14, a coin acceptor and totalizer receives the coins and then a sensing system arranged with an outer housing assembly for the coin mechanisms unlocks the vending device 10 for operation. In solid lines, FIG. 1 illustrates the pull-push handle means 15 in the at-rest position. When unlocked, it may be pulled outwardly as shown in phantom lines. Beneath the handle means 15 is an access outlet generally at 16 which is covered by a hinged outlet door means 17 through which the newspaper will be pulled. In the illustrated embodiment door means 17 is of a generally conventional design and it is pivoted along an upper margin to act as a weatherproof device protecting the interior of the housing 11 from snow and rain.

The loading door 12 also includes an advertising panel 18 for use by the newspaper publisher to sell advertising space or to promote the publication itself. A coin return slot 19 is arranged through the loading door 12 for the return to the customer of defective coins, excess coins entered, or coins returned when the vending device 10 is empty. Also, a coin return lever 19' is mounted on the housing 11 and cooperative with a coin acceptor to clear and return jammed coins from the acceptor to the return slot 19.

When the appropriate amount of coins has been entered through coin slot 14 and received by the coin acceptor, the vending machine, or system, 10 is unlocked and thereby pull-push handle means 15 may be moved outwardly by the customer's hand to the position shown in phantom lines. This action readies an ejector means for pulling a paper outwardly through the access outlet 16.

In FIG. 2 this ejecting action is shown to provide for the extension of a newspaper outwardly of the access slot 16 sufficiently far in order to be grapsed by the purchaser. The pull-push handle means 15 is depicted as it appears when returned to its at-rest position and locked with the vending machine 10 ready for receipt of a subsequent insertion of coins thereby again unlocking the pull-push handle means 15 for use.

In FIG. 3, the coin insert slot 14 arranged with an instructional and informational panel 20 showing the cost for the daily and Sunday paper prices, the description of the pull-push handle means 15 for operation by the customer, information as to the use of the proper coins, and directions to obtain coins returned when the vending device 10 is empty.

The vending device 10 in the illustrative embodiment allows for two differently priced newspapers to be vended as noted on the instructional panel 20. The vending device 10 includes means for unlocking the pull-push handle means corresponding to each required amount of coins for differently priced items to be sold. A sensing means for sensing the number of coins received for different total required amounts controls the unlocking of the pull-push handle means 15 and the associated operational assemblies as will be explained.

DESCRIPTION OF THE EJECTOR SYSTEM

The means for ejecting a newspaper through the outlet access 16 by the operating the pull-push handle means 15 is best viewed with reference to FIGS. 4, 4A, 4B, 4C, 5, 6 and 7.

FIGS. 4, 4A, 4B and 4C are schematic depictions of the operation of the ejector mechanism generally referenced at 22.

FIG. 5 is a horizontal plan view looking downwardly into the interior of the housing 11 with a horizontal top housing wall, referenced at 21, removed.

FIGS. 6 and 7 show a needle assembly for the ejector system 22 in greater detail.

The ejector mechanism 22 will be described beginning with the support frame means for the pull-push handle means 15, comprising front and rear channel supports 23 and 24, respectively and mounted between right and left side frame channel members 25 and 26, respectively, and together generally forming an upper frame means referenced at 27. Bushings 28 and 29, respectively mounted through apertures in the front and rear channel supports 23 and 24, slidably accommodate a lower rod 30 of the pull-push handle means 15 for reciprocating motion therethrough. The pull-push handle means 15 moves inwardly and outwardly of the front support channel 23 generally above the paper tray referenced at 31, which moves like an elevator in a vertical path therebelow as will be described hereinafter.

The slidable rod 30 of the handle means 15 is drivingly attached to an actuator plate 32. An actuating link 33 is pivotally connected to the actuator plate 32 at pivot connection 34 at one end thereof. At another end, the actuating link 33 is pivotally connected at 35 to an actuating arm 36. The actuating link 33 is thus movable as it is carried by the actuator plate 32 responsive to the driving movement of the rod 30 backward and forward. A fixed pivot bracket 37 is attached to the rear support channel 24 and pivotally attaches to the actuating arm 36 at pivot 38. The use of rivets such as at 34, 35, and 38, and as for use elsewhere for the vending machine 10, is well known in the art and specific details will not be given as they would be understood by one skilled in the art. The pivot 38 is nearer the pivot 35 than a pivot 39 at the other end of the actuating arm 36 which is in pivotal engagement with another actuating link 40 as shown. The distance from pivot 38 to pivot 39 versus from pivot 38 to pivot 35 controls the travel distance that the pivot 39 experiences. In a preferred form shown, the pivot 38 is closer to the first mentioned actuating link 33 whereby the pivot point 39 travels through a greater arc, as illustrated. The actuating link 40 is arranged to move back generally toward the front channel support 23 and terminates at its other end in a pivotal connection 41 arranged in pivotal engagement with an ejector actuator bracket 42.

The ejector actuator bracket 42 is reciprocally driven by the movement of the rod 30 in an opposite relationship caused by the reverse pivoting action at 38, whereby correspondingly driving the actuating links 33 and 40 in opposite directions thereabout. The ejector actuator bracket 42 is attached to an ejector bracket 43 thereunderneath, such as by welding or the like. The ejector bracket 43 is slidingly and rotatably engaged to an ejector shaft 44 that extends between the front support channel 23 and rear support channel 24. The ejector bracket 43, observed from the side, has a generally downwardly opening U-shape and is bored through front and back downward legs of the U-shape at 45 and 46 for receipt therethrough of the ejector shaft 44, whereby to render the ejector bracket 43 slidable and rotatable on the ejector shaft 44.

The ends of the ejector shaft 44 are formed to have smaller diameter stub shafts 47 and 48, respectively mounted at the front support channel 23 and rear support channel 24. The stub shafts 47 and 48, respectively, reside at brackets 49 and 50 which depend from the front support channel 23 and the rear support panel 24. Mechanical friction holders 51 and 52, respectively, hold the stub shafts 47 and 48 at the outer sides of the brackets 49 and 50. The brackets 49 and 50 are bored to accommodate the stub shafts 47 and 48. In the disclosed embodiment the ejector shaft 44 is prevented from longitudinal translation and serves to slidably and rotatably accommodate the ejector bracket 43 thereon.

The product-engaging portion of the ejector system 42 is provided at an ejector plate 53 which is mechanically fastened, such as by rivets, to the downward legs of the U-shaped ejector bracket 43 to be carried thereby responsive to the movement of the ejector bracket 43 along the shaft 44. In the preferred embodiment, one needle holder assembly 54 is provided at each side of the ejector plate 53 for engaging copies of newspapers, generally referenced at N, resting atop the product tray 31. The needle assemblies 54 each comprise a pointed wire-type spring needle 55 mounted at the end of a pivoting needle holder 56. A nut-bolt-washer assembly 57 pivotally connects the needle holder 56 to the ejector plate 53. A second nut-bolt-washer assembly 58 engages the needle holder 56 through a bore 59 therethrough generally midway between the needle 55 and nut-bolt-washer assembly 57. The assembly 57 further secures a tension spring 60 which is bolted at 61 to a rearward portion of the ejector plate 53. A lug 64 serves as a pivot stop for the needle holder 56 against which the tension spring 60 pulls the needle holder 56, whereby the needle assembly 54 is spring biased to return to an oblique angular relationship having the needle 55 forwardly inclined toward the product tray 31. The spring bias pivot action of the needle holder 56 allows for the needle 55 to move away from upper surfaces of newspapers N during the pulling stroke on the handle means 15 so not to drag across the upper pages of the newspaper and tear them. In conjunction with an advancing system for the product tray 31, which will be described hereinafter, the upper surface of the sequential newspaper N are controlled to stop at a level just below the ejector plate 53 so that the ejector plate 53, as it moves forward, holds the needles 55 projecting therebelow about $\frac{1}{8}$ to $\frac{5}{8}$ of an inch, in the preferred embodiment, and able to piercingly engage the upper pages of the newspapers N. Thereby, a goal is achieved by preventing the ejector plate 53 from dragging along the upper surfaces of newspapers and binding against them during extraction. Clearly, with large, bulky newspapers, such as Sunday editions, there are many insert sections and variously shaped items, such as television guides, which cause the newspapers to bow-up unevenly. Accordingly, should this unevenness cause contact between the upper surface of the newspaper with the ejector plate 53, it is preferable that the front bracket 49 for the ejector shaft 44 provide an oval-shaped slot therethrough which allows for upward freedom of movement for the stub shaft 47. Thereby, if the ejector plate 53 encounters an uneven portion of a newspaper surface, the stub shaft 47 accommodates the unevenness by being upwardly movable and further prevents the ejector plate 53 from binding against the stack of newspapers N. At the same occurrence, the free rotation of the ejector bracket 43 on the shaft 44 also compensates for uneveness and permits the ejector plate 57 to roll left and right over bumps and the like.

Because the vending device 10 may be useful with a variety of articles of merchandise, including newspapers N of from a few pages thin to hundreds of pages thick, it will be understood that with thinner publications having only a few pages, the spring needles 55 might pierce through the full thickness of the newspaper N. Therefore, to protect the needles 55 from deleteriously scraping across the top of the product tray 31 during the pushing stroke of the handle means 15, clearance slots 54*a* are provided through the product tray 31, as shown in FIG. 8, and extend for the full traveling path of the needle assemblies 54 so that they may be allowed to safely project through the product tray 31. This is also a beneficial feature when the product tray 31 has been emptied and the product tray 31 is closely adjacent the ejector plate 53 which, without the clearance slots 54*a*, could otherwise put the needle assemblies 54 and spring needles 55 into scraping contact on top of the product tray 31 during reloading.

Figure 4:
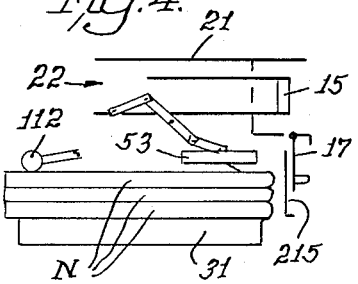
FIG. 4 is a schematic of the ejector system of the invention showing an ejector plate with newspaper-engagable needles for pulling a newspaper out and showing the inner theft resistant slide door and outer pivoting access outlet door at-rest with the handle means prior to the customer inserting coins to make the purchase.
Figure 4A:
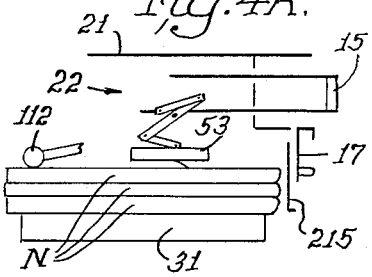
FIG. 4A is also a schematic and shows the handle means pulled out following the insertion of the coins and the reciprocating ejector plate driven in the opposite direction poised for a subsequent forward movement to pull the newspaper outwardly.
Figure 4B:
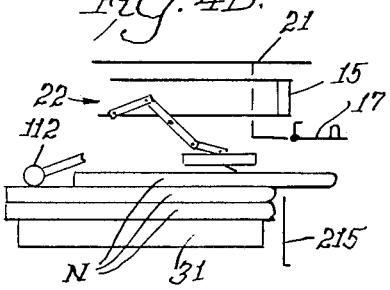
FIG. 4B is also a schematic and shows the handle means pushed inwardly and the ejector plate and needle moved forwardly to pull a newspaper outwardly as the anti-theft slide door is moved downwardly to allow the newspaper to pass thereover so to be expelled through the pivoting open access outlet door.
Figure 4C:
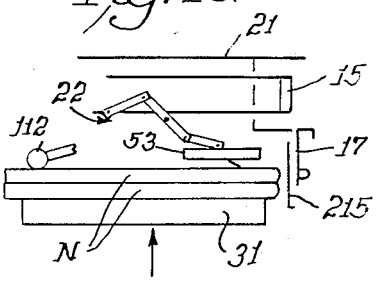
FIG. 4C is also a schematic and depicts the upward movement of a subsequent paper into the arrangement as in FIG. 4 wherein following the vending of a newspaper the theft resistant slide door and outer access door are closed and the handle means is in the at-rest position ready for a subsequent purchase.

It will therefore be apparent that the pulling movement at handle means 15 drives the ejector bracket 43, carrying the ejector plate 53, rearwardly as the spring needles 55 safely and resiliently pivot forwardly. The tension caused by springs 60 urges the spring needles 55 to be pulled back to the set oblique angular relationship against the lug 64 when the ejector plate 53 reaches the ready position as in FIG. 4A. Thereafter, the handle means 15 is pushed inwardly carrying the rod 30 to return through bushing bracket 28 and pushing the actuator plate 32 rearwardly. As a result of the mechanical linkage described, the ejector bracket 43 is caused to reciprocally move forward carrying the ejector plate 53 over the upper surface of the newspapers N whereby to engage at least one needle assembly 54 with a newspaper N to pull it outwardly through the access outlet 16 as shown in FIG. 4B.

BRAKE ASSEMBLY FOR ADVANCING THE PRODUCT TRAY

Figure 9:
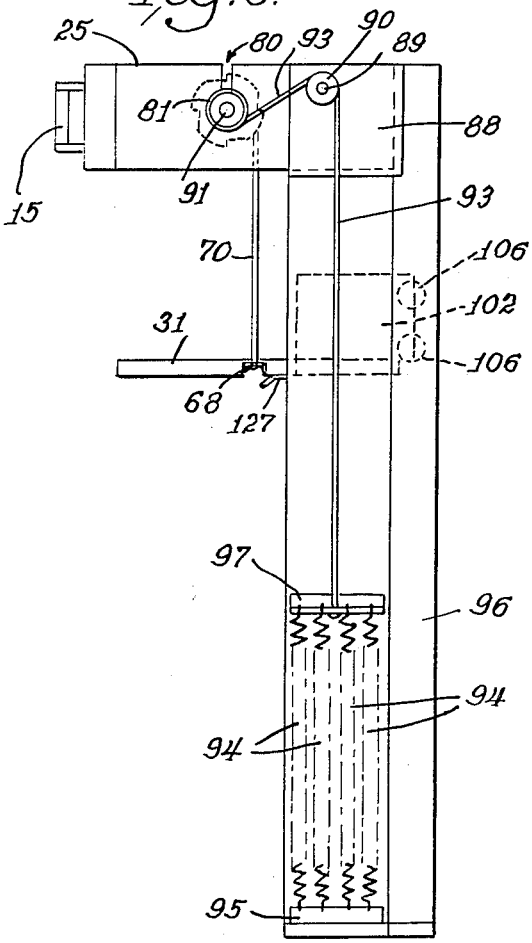
FIG. 9 is a right side elevational view of the spring loaded cable and pulley assembly for the product tray looking interiorly of the vending machine shown in FIG. 1.
Figure 10:
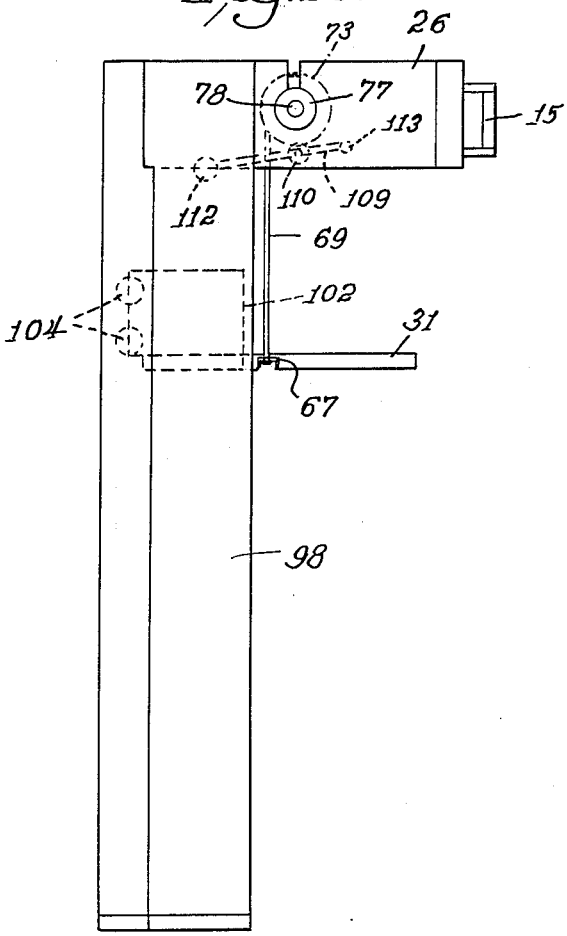
FIG. 10 is a left side view of the spring loaded product tray and showing the brake lock mechanism for the pulley and cable system.

A brake lock system generally referenced at 65, best viewed in FIGS. 5, 9 and 10, is provided to control advance of the product tray 31 in cooperation with a spring loaded cable and pulley system generally referenced at 66. The function of the brake lock mechanism 65 is to adjust the upward advance of the product tray 31 after each purchase, so that the products, such as newspapers N, placed on the tray 31 are all sequentially adjusted to have their upper surfaces placed into substantially the identical position relative to the ejector plate 53 as the preceding product and allowing the ejector plate 57 in cooperation with the needle assembly 54 to repetitively dispense a topmost product positioned in the vending device 10. The brake lock mechanism 65 self-adjusts to the thickness of the immediately preceding product so to advance the tray 31 upwardly the appropriate distance for the next product to have its upper surfaces engageable by the ejector mechanism 22.

The brake lock mechanism 65 serves to control the incremental advance of the spring loaded cable and pulley system 66 which will be described beginning with the product tray 31.

The product tray 31 includes two outwardly extending cable brackets 67 and 68. A left side cable 69 attaches to the bracket 67 and a right side cable 70 attaches to the bracket 68. A left pulley 71 includes two side plates 72 and 73. The tray-inward side plate, side plate 73, is provided with circumferential main gear teeth 74 whereby the side plate 73 is also functionally describable in the invention as being a main gear 74, as will be understood hereafter. The side plates 72 and 73 are closely spaced to allow for a tight single layer wrapping on a pulley wrap hub 75 therebetween. The left pulley 71 is rotatably attached to a pulley shaft 76. The pulley shaft 76 is journaled at the left side of the vending device 10 at the side frame channel 26 of the upper frame means 27 by means of a pulley shaft hub 77 with a hub bearing 78 to the outer side of the frame channel 26 and a conventional pulley shaft bushing 79 extending from the inner side of the pulley 71 to the bearing 78. As the product tray 31 moves up and down it is supported by the cable 69, which wraps and unwraps around pulley wrap hub 75.

At generally near the opposite end of the pulley shaft 76, a right pulley 80 is rotatably arranged, which is supported at the right side frame channel 25 of the upper frame means 27 by the provision, similar to the left pulley 71, of a pulley shaft hub 81, a bearing 82 and pulley shaft bushing 83. The pulley includes side plates 84 and 85 which include a pulley shaft hub 86 therebetween for accommodating, in single layers, the wrapping and unwrapping of the supporting cable 70 as the product tray 31 moves upward and downward.

The side plates 84 and 85 are provided with ratchet-like notches 87 which, as viewed from the right side of the vending device 10 in FIGS. 5 and 9, are provided to be caught by a ratchet lever to control the counter-clockwise upward advancement of the product tray 31 during reloading, as will be described below. In the preferred embodiment, the side plates 84 and 85 are provided with four ratchet notches whereby the rotation is capable of being stopped at each quarter rotation.

At the outward side of the side frame channel 25, a pulley bracket 88 is attached to and spaced from channel 25 for journaling therebetween a cable sheave bushing and shaft 89 carrying a pulley sheave 90. The pulley shaft 76 extends from the pulley 80 outward of the side frame channel 25 to be drivingly engaged by a cable wrap hub 91 residing in substantially the same vertical plane as the pulley sheave 90 as shown in FIG. 5. In preferred form, the cable wrap hub 91 has a cable-accommodating spiral grooving 92 for collecting therealong a drive cable 93. The cable 93 is fixed to the cable wrap hub 91, such as by set screws, and wraps and unwraps in the spiral groove 92 as the product tray 31 moves, respectively, downward during loading and upwarding during vending. The cable 93 is tensely connected at its other end with a plurality of closely wound tension springs 94, which in the illustrated embodiment comprise four 0.120 inch wire springs having an outside diameter of one inch and 124 closely spaced coils. The pulling force preferably provides for about 120 lbs., or more, in order to accommodate a full loading of papers on the product tray 31, which in the described embodiment may be a 32 inch full stack of newspapers N. The tension springs 94 are affixed at lower ends to a bracket 95 at the bottom of a vertical roller channel frame 96 and are attached at upper ends to a movable upper bracket 97 that connects to the cable 93 for pulling thereagainst. The tension springs 94 provide a minimum amount of downward tension even when the product tray is dispensing the last newspaper. In the preferred embodiment about 20 pounds, plus or minus 2 pounds, of upward pulling force is transmitted to product tray 31 by the downward spring biasing of the cable 93 over the sheave 90, which serves to bias the cable wrap hub 91 into rotation and thereby the shaft 76 attached thereto. The biasing of the shaft 76 causes the cables 69 and 70 to be tensed to wind around the pulleys 71 and 80 for advancing the product tray 31.

The product tray 31 is movable in a space defined at the right side of the vending machine 10 by the aforementioned roller channel frame 96, and at the left side by another roller channel frame 98 connected therebetween at the rear of the vending machine 10 by a back panel 99. The back panel 99 having a central roller track channel 100 that opens toward the product tray 31 and extends vertically from the top of the back panel 99 down to a bottom panel 101. The bottom panel 101 generally provides a bottom wall for a frame means defined by the roller channel frames 96, 98, back panel 99, which frame means also supports the upper frame means 27 to project forwardly thereof at the upper portion of the vending machine 10 forming a generally upside down L-shape, as observed in FIGS. 9 and 10. Accordingly, the back panel 99 is spaced rearwardly of the back support channel 24 for the ejector shaft 44.

Figure 11:
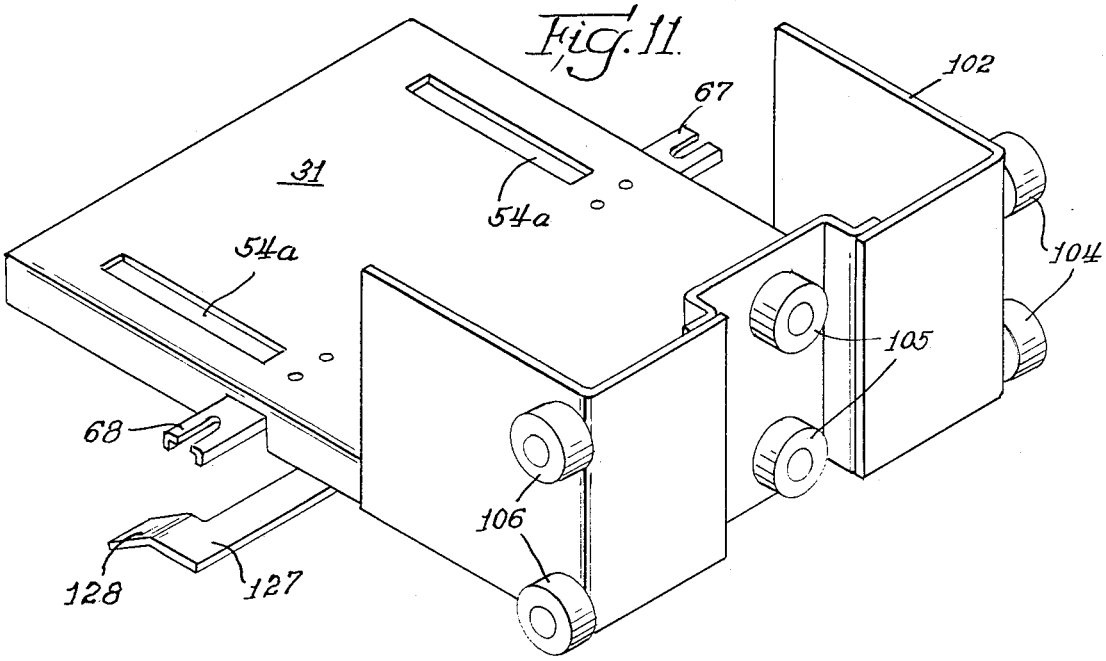
FIG. 11 is a perspective view looking downwardly from the rear of the product tray or shelf, having roller wheel means for faciliating vertical sliding movement.

Turning now to the perspective view of FIG. 11, it will be seen that the product tray 31, in the exemplary embodiment, includes an upstanding rear wall panel 102 that is generally U-shaped and is able to move upwardly with the product tray 31 to fit within the space between the rear support channel 24 and the back panel 99. The rear wall panel 102 is indented to have a central back channel 103. In the disclosed embodiment three pairs of roller wheels 104, 105 and 106 are rotatably journalled on the rear wall panel 102. The roller channel frames 96 and 98, respectively, are shaped to define channels 107 and 108 for movably accommodating the pairs roller wheels 104 and 106. The rear wall panel 102 forms a back wall of the channels 107 and 108. The center roller wheel pair 105 is movably accommodated in the rear channel, or track, 100 of the back panel 99. The combination of the rear wall panel 102 and the pairs of roller wheels 104, 105 and 106 aid in balancing the product tray 31 when products are held thereon. Thus, a controlled vertical movement of the product tray 31 is provided by the cables 69 and 70 supporting it at the brackets 67, 68 and the roller wheels 104, 105 and 106 maintaining the product tray 31 in a balanced level arrangement as they are guided within the channels 100, 107 and 108 as described.

There is a compensating spring loading arrangement so that as the product tray 31 is filled with greater amounts of merchandise and receives more weight, the tray 31 is moved downwardly against the tension of the tension springs 94 which exert an oppositely directed pulling force transmitted by the cable 93 to the cable wrap hub 92 to thereby spring load the shaft 76. The control of the spring loaded upward advancement is achieved by the provision of the brake lock mechanism 65.

The brake lock mechanism 65 consists primarily of a pivoting brake arm 109 that carries a lock gear 110 thereon. A brake wheel shaft 111 is attached to a rearward end of brake arm 109 and extends over the paper tray 31 to terminate generally centrally thereabove. A brake wheel 112 is rotatably supported on the brake wheel shaft 111 to be generally parallel to the direction in which the newspapers N are ejected.

A spacer and bushing assembly 113 pivotally attaches a forward end of the brake arm 109 to the left side frame channel 26 by means of a mechanical bolt fastener, or the like. The brake arm 109 carries a circular lock gear 110, which is a pinion-type gear wheel, that is attached in vertical postional alignment for engagement with the main gear 74. In the disclosed embodiment, the main gear has 120 teeth and lock gear 110 has an outside diameter of one inch, comprises 24 teeth, and is made of case hardened cold-rolled steel for long wear life. The lock gear 110 has sharp gear teeth and is releasably locked by a fastener 114 to brake arm 109 so that it may be rotated to a new teeth-engagable position and reclamped for extended life, inasmuch as repetitive wearing engagement with the main gear 74 is required for the brake lock function of the vending device 10. The pivot action of the brake arm 109 in the counterclockwise direction moves the lock gear 110 upwardly for gear tooth engagement with the meshing teeth of the main gear 74. Thereby, the pulley 71 is locked on the shaft 76 so that the product tray 31 is locked in place at the gear-like engagement. The pivot action of the brake arm 109 is controlled by the disposition of the roller wheel 112 on top of the upper surface of a newspaper N to be dispensed. In the at-rest position as shown in FIG. 4, the roller wheel 112 sits atop the upper surface of the next newspaper and the lock gear 110 is engaged to main gear 74. While the lock gear 110 is engaged to main gear 74, the brake arm 109 of the disclosed embodiment is disposed at an 8% slope relative to the plane of the product tray 31. As the pull-push handle 15 is operated to first bring the ejector plate 53 backwards ready for pulling against the newspaper, the roller wheel 112 rotates across the upper surface of the top newspaper N until as shown in FIG. 4B the newspaper is dispensed outwardly through the access outlet 16 whereby the roller wheel 112 falls off the newspaper to the upper surface of the next sequential newspaper N. At that moment the brake arm 109 pivots downwardly to disengage the lock gear 110. In so doing, the upward force caused by the tension springs 94 and the drive cable 93 biases the topmost newspaper N upward against the ejector plate 53 so that there is firm positive contact against the needle assemblies 54 that they may piercingly engage and pull a newspaper N outwardly. As noted above, about twenty pounds of upward force is constantly maintained on product tray 31 for this purpose. In the disclosed embodiment, a newspaper N is moved by the ejector plate 53 approximately five inches and projects outwardly of the access outlet 16. When the purchased newspaper N is removed from the stack, the next sequential copy is biased upwardly by the spring loaded cable and pulley system 66 to push the roller wheel 112 and brake wheel shaft 111 to pivot the brake arm 109 upwardly for re-engagement by the lock gear 110 with the main gear 74. It is important to note that the brake lock mechanism 65 is self-adjustable to the thickness of a newspaper N being dispensed because it is the upper surface of the next newspaper N advancing upwardly that sets the point at which the product tray 31 locks regardless of the thickness of the newspaper in the process of being removed by the ejector. This means that the brake arm 109 simply pivots down more, or pivots less, depending on the thickness of the newspaper being dispensed and can only re-engage the lock gear 110 at one elevation of the brake wheel 112, because it is the upper surface of the next product that moves upward against the roller wheel 112 to raise it to pivot the lock gear 110 to meet the main gear 74.

In the illustrated embodiment, the location of the roller wheel 112 is about 1 to 2 inches from the rear edge of the newspapers N in the stack. Thus, any newspaper N being dispensed is slightly moved off the product tray 31 for this small distance whereupon the lock gear 110 is disengaged as the roller wheel 112 falls off the trailing edge. In general, the newspapers N are envisioned as comprising either a folded broad sheet publication which is usually 15 inches wide when folded, or a tabloid publication which is typically 15 inches long. While the invention is not limited to newspapers and may be used with a variety of flattened-type products to be dispensed, including those that may be packaged in various envelopes and the like, the illustrated embodiment can accommodate a newspaper up to about 3 inches thick. Differing thicknesses in any stack of newspapers due to missing sections, uneven stuffing, and the like, can easily be accommodated because the brake lock mechanism 65, as explained, self-adjusts to thickness variations and the locking is controlled by the contact with the upper surface of the next advancing newspaper.

LOCKOUT ADJUSTMENT ASSEMBLY TO FACILITATE LOADING

Figures 17, 18, 19:
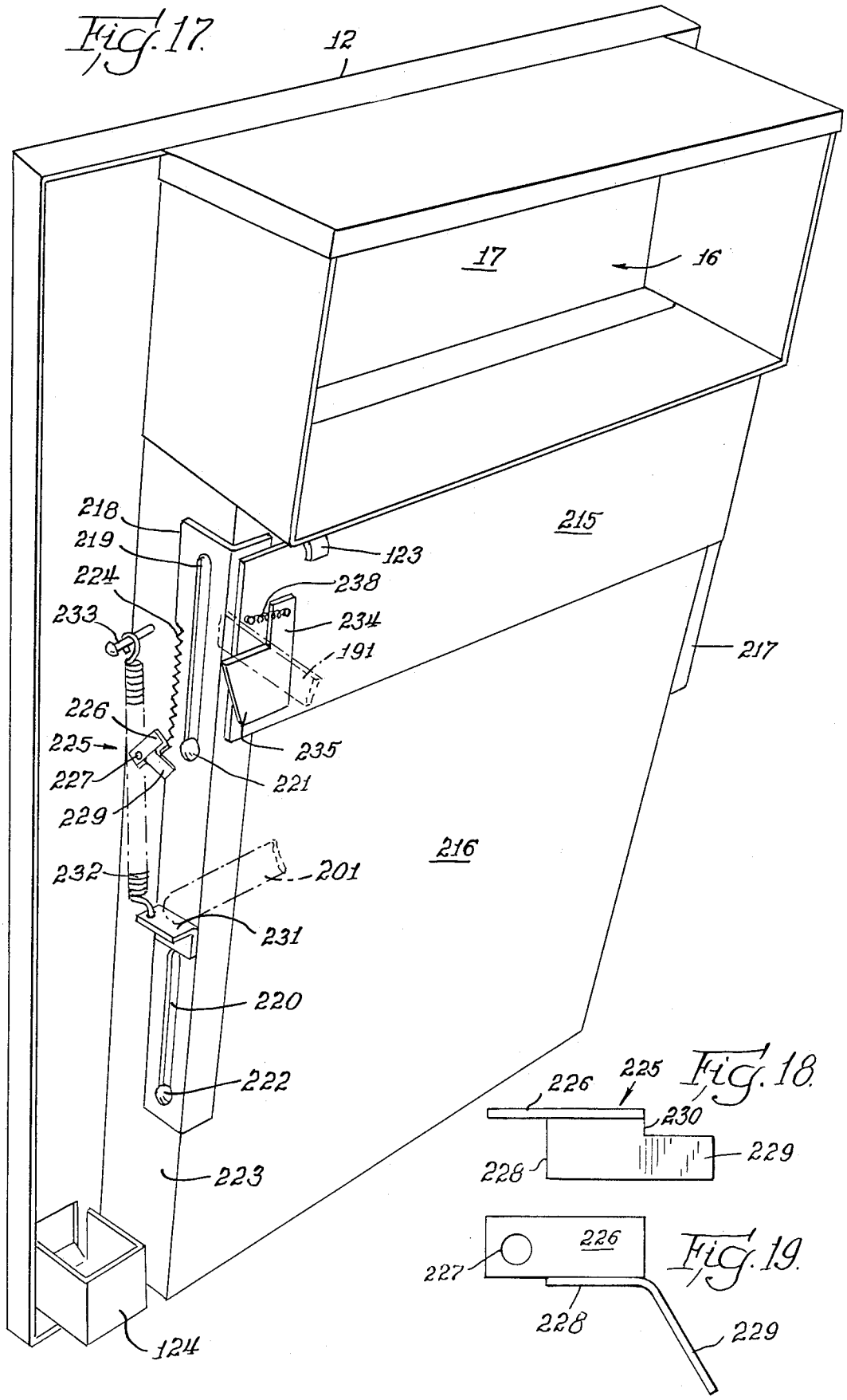
FIG. 17 is a perspective view of the inner side of the pivoting loading door for the vending device and showing an inner sliding trap door assembly including a pawl ratchet.
FIG. 18 is a top view of a pivoting lock bracket forming the pawl for the ratchet of the sliding door assembly as shown in FIG. 17.
FIG. 19 is a side view of the pivoting lock bracket as shown in FIG. 18; and, FIG. 20 is a front view of a latch plate for the inner sliding trap door assembly for detaining a lockout arm and maintaining the sliding trap door momentarily in the open position as shown in FIG. 17.

The vending device 10 is commercially advantageous. Because of the single-dispensing feature a larger amount of selling space may be provided than with the old "honor" box systems. In the illustrated embodiment 32 inches of selling space is provided as measured from the product tray 31 in its lower most position upwardly to the ejector plate 53. In this regard, the reloading of the vending machine 10 is intended to be safely and conveniently controlled by the provision of a lockout adjustment generally referenced at 115. Reference is now made to FIGS. 1, 8 and 17. The lockout adjustment 115 is cooperative to engage the right pulley 80 at the ratchet notches 87 of the side plates 84 and 85 when the loading door 12 of the housing 11 is open for replenishing the product tray 31 with a new batch of articles of merchandise. The lockout adjustment serves the purpose of allowing the product tray 31 to be incrementally advanced for loading only a portion of the full amount of newspapers and locked at an elevation while the newspaper delivery driver takes another handful to place on the stack. By locking the rotation of the pulley 80, and thereby the spring loaded cable and pulley system 66, the driver's hands are both free and there is a safety feature provided by keeping the tray from inadvertently springing upwardly. This control also makes loading easier.

The lockout adjustment 115 includes a lockout arm 116 that is slidably supported on a finger 117 that projects from the front support channel 23 and extends through an elongate slot 118 located near one end of the lockout arm 116. At an opposite end, lockout arm 116 is pivotally connected to a lockout lever 119 which is pivotally mounted on the right frame channel 26 generally at pivot connection 120. A flange 121 projects at right angles from the lockout lever 119 to be movable into the path of the ratchet notches 87 to prevent the counter revolving motion of the pulley 80 which would otherwise occur by the spring loading transmitted from the cable wrap hub 91 to the shaft 76. The engagement of the flange 121 with one of the notches 84 occurs when the loading door 12 is opened. The lockout arm 116 is spring biased to pivot the lockout lever 119 into ratchet engagement by the provision of a tension spring 122 which is attached at one end to the lockout arm and to the front support channel 23 at the other. In FIG. 8, the lockout adjustment 115 is shown engaged to prevent the upward advancement of the product tray 31 but allows the delivery driver to utilize the ratchet action to move the tray 31 downwardly for loading a supply of newspapers N.

When the door 12 is closed, the lockout lever 119 is pivoted out of engagement with the ratchet notches 87. To pivot the lockout lever 119 from engagement, a contact bracket 123 is arranged on the door 12 in alignment with the lockout arm 116 as shown in FIG. 17. The lockout arm 116 is sufficiently long to project outwardly beyond the front edge of the product tray 31 so that upon closure the lockout arm 116 is pushed back against the spring tension upon contact with the contact bracket 123. Thereby, the lockout lever 119 is caused to pivot at 120 and disengages the flange 121 from a ratchet notch 84. When this occurs the shaft 76 is again drivingly rotatable by the spring loaded cable and pulley system 66 to lift the product tray 31 upwardly until the brake lock mechanism 65 engages the main gear 74 to lock the system.

COIN DEFLECTOR ASSEMBLY

The vending device 10 of the invention is operational with conventional coin accepting and coin totalizing mechanisms known in the vending industry wherein coin acceptors have an insert chute, or slot for receiving coins delivered from the coin insert slot 14 of the housing 11. Thereafter standard coin accepting mechanisms direct nickels, dimes and quarters, for example, into internal slots of corresponding sizes so that only true coins are accepted and moved downwardly through second slots into the coin totalizer. Coin totalizers include tripping lever means for counting the coins received in various denominations and which incrementally turn a rotatable price wheel shaft means corresponding to the value of each coin collected. A cam wheel is usually provided with the coin totalizer which is mounted on a shaft that is incrementally turned until at receipt of the full price a cam notch has reached an unlocking position of rotation. For example, if twenty-five cents is required, then if the correct amount of nickels are inserted the cam would advance five incremental rotional advances, or one single rotation equalling five increments should a quarter be received. One conventional coin accepting mechanism usable in the invention is a COINCO brand, Model No. 790-7, made by Coinco Co., of St. Louis, Missouri, which mountably may associate with a coin totalizer arranged therebelow of the same manufacturer, or made by another, such as the SCS, 13-03 Series, mechanical totalizer made by National Rejectors, Inc.

For the vending device 10 of the invention, the housing 11 is arranged to accommodate a coin accepting and totalizing mechanism generally in the upper right hand front corner of the housing 11 of the device 10 adjacent the coin insert slot 14. FIG. 17 depicts the inner side of the loading door 12 and provides a coin return outlet 124 in the lower portions thereof for the return of coins that are not accepted by a coin accepting mechanism. The present invention includes the provision of a coin deflector assembly 125, as shown in FIG. 16, for cooperative action with a coin acceptor mechanism whereby to deflect coins from the accepting slots to the coin return outlet 124 after the last copy of a product has been sold so that subsequent customers are not cheated. The invention provides for deflecting the coins in the coin acceptor to its usual return slot path for slugs, or malformed coins, and into the return outlet 124, rather than passing through the acceptor to the coin totalizer. The vending machine 10 will also be described with respect to FIGS. 12 and 15, which show an outer housing assembly 126 that is usable with coin acceptor and coin totalizer mechanisms and includes sensing and unlocking means cooperative with the coin totalizer in order to unlock the pull-push handle means 15 when the appropriate value of coins is inserted.

The details of coin acceptor and coin totalizer mechanisms are not specifically configured in the drawings and are not needed to teach one skilled in the art how to practice the present invention. A wide variety of commercially available coin mechanisms are usuable with the invention but alone form no part of the invention.

Figure 12:
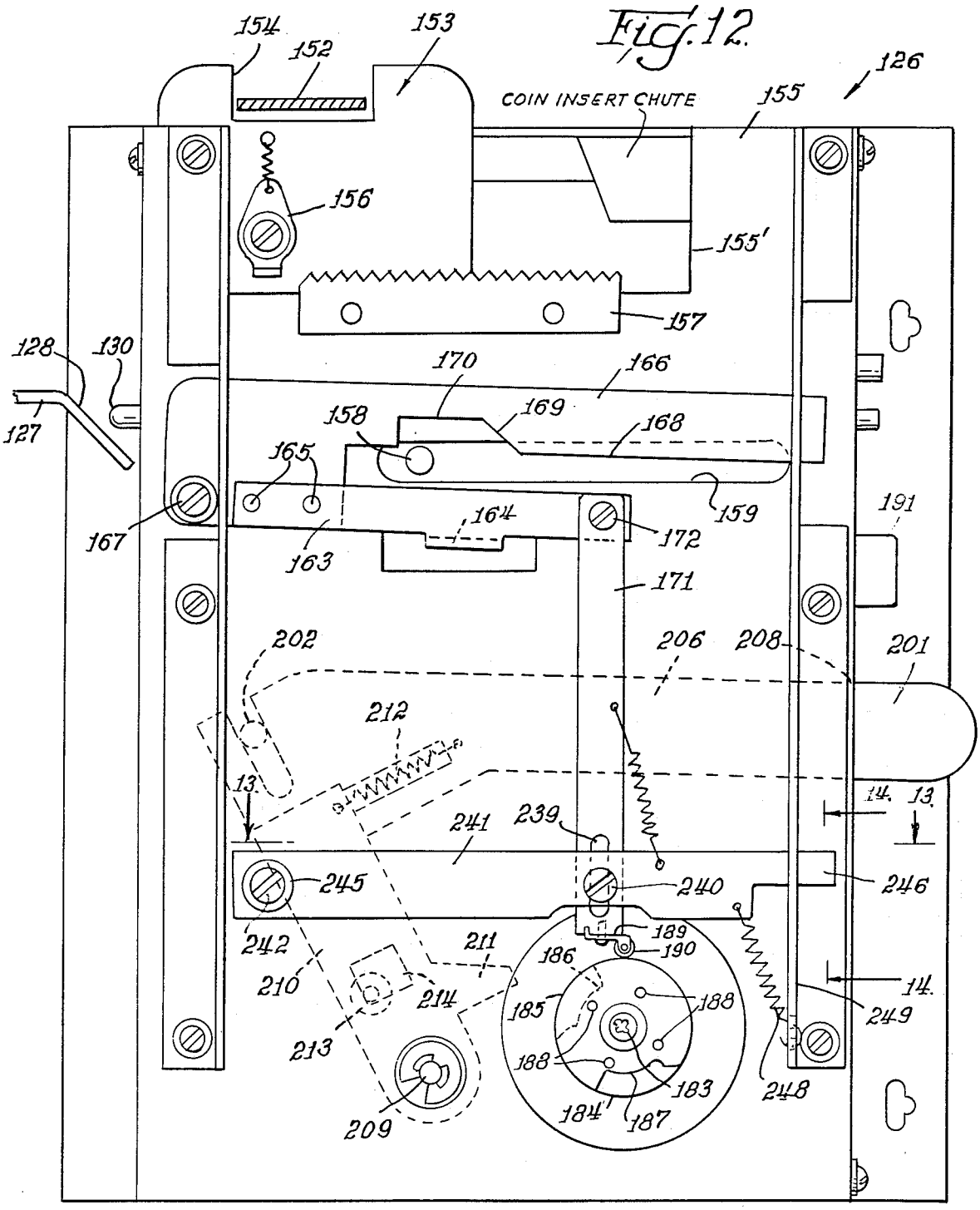
FIG. 12 is a face view of an outer housing assembly mechanism for cooperative action with a coin acceptor and coin totalizer and including unlocking means for the vending system, movable arms for controlling the opening of an anti-theft inner trap door and an adjustment for changing the value of the coins inserted in which the system will unlock and a movable push rod for activating a coin deflector mechanism when the last product has been dispensed.

Turning to FIGS. 8, 12, 15 and 16 there is perspectively depicted a coin release bracket 127 having a downwardly bevelled flange 128, which is supportably carried by the product tray 31. The coin release bracket 127 moves in a vertical path which carries the bevelled flange 128 to contact a movable horizontal shaft, or rod, 129 that is slidably supported by the housing assembly 126. An end 130 of the shaft 129 resides in a vertical position ready for biasing contact by the bevelled flange 128 when the last product on the shelf 31 is dispensed. Upon the advancement by the release of the brake lock mechanism 65 after the last article is sold, the product tray 31 is spring advanced so that the coin release bracket 127 meets the horizontal shaft 129, which is pushed inwardly of the coin mechanism outer housing assembly 126 as illustrated in FIG. 12. Accommodating apertures are provided through walls of the outer housing assembly 126 of a size slightly larger than the shaft 129 to allow for the horizontal translation thereof. The coin deflector assembly 125 provides for the pivoting of a coin deflector plate 131 to enter outer openings for the coin slots of a coin acceptor mechanism to deflect the coins from the receiving paths therein. The coin deflector plate 131 is pivotal on a rod 132 that is vertically supported by a bracket 133 mounted to a side of a coin acceptor and totalizer mechanism. The bracket 133 includes sidewardly bent opposing flanges 134 and 135 which have bores 136 and 137 for rotatably accommodating the rod 132 therein. There is an annular groove, shown at 138, adjacent the upper end of the vertical shaft 132, which is engageable, when extended above the flange 135, by a mechanical clip fastener 138' to prevent the rod 132 from sliding outwardly of the bores 136 and 137.

The coin deflector plate 131 includes a first flange 139 that is attached, such as by welding, to the shaft 132. A second flange 140 extends at right angles to the first flange 139 and extends across a coin acceptor mechanism housed in the outer housing assembly 126, whereby to arrange fingers 141, 142 and 143 formed therewith to be ready for rotational insertion into coin pathways of the coin acceptor mechanism. The spacing and depth of the fingers 141, 142 and 143 may be provided in a wide range of spacings and sizes in order to correspond to a particular manufacturer's coin acceptor dimensions and to be compatible therewith. The first flange 139 has an opening, preferably such as a slot 144, which is pivotally engageable by the horizontal shaft 129 and held therewith by, for example, friction fasteners 145 and 146 gripping the shaft 129 at either side of the first flange 139 in order to be movable in unison with the coin deflector plate 131 whereby to pivot the coin deflector plate 131 responsive to the pushing movement caused by the coin release bracket 127.

The coin deflector plate 131 is normally biased by a tension spring means 147 which is affixed at one end at a hole 148 in the first flange 139 and the opposite end is mechanically attached to a wall 149 of the outer housing assembly 126. The spring 147 pivots the coin deflector plate 131 away from the coin slots of the coin acceptor mechanism until such time that the last newspaper N is dispensed whereby the coin release bracket 127 urges against the horizontal shaft 129 thereby pivoting the fingers 141, 142 and 143 into the coin slot pathways of the coin acceptor mechanism. It would be understood for the preferred embodiment that with respect to selling newspapers the coin slots would typically accommodate quarters, nickels and dimes to be accepted in that order due to the descending sizes. The fingers 141, 142 and 143 would then be correspondingly positioned to deflect quarters, nickels, and dimes, respectively, to the coin return slot of the coin acceptor mechanism for return to the customer at coin return slot 19, which associates with the coin return outlet 124.

The attachment of the bracket 133 is illustrated by the use conventional screw fasteners 150 affixing the bracket to outer sides of coin acceptor and coin totalizer mechanisms. However, many alternate attachment means may be provided for adaptation to coin acceptors and coin totalizer conformations for the purpose of mounting the inventive coin deflector assembly 125 to be cooperative therewith.

ANTI-THEFT INNER DOOR MECHANISM AND COOPERATIVE SENSING APPARATUS FOR UNLOCKING THE SYSTEM UPON INSERTION OF THE CORRECT VALUE OF COINS

It will be observed from the plan view of FIG. 5 that the actuator plate 32 which is drivingly engaged by the pull-push handle means 15 includes a sideward double-bent driving flange structure 151 formed with a generally horizontal tongue 152. The tongue 152 extends generally transverse to the handle means 15 and slightly outwardly underneath the right side frame channel 25 where it is drivingly engaged to a slide plate 153. The slide plate 153 is movably mounted at the coin mechanism outer housing assembly 126. The slide plate 153 is releasably engaged within the outer housing assembly 126 whereby until the slide plate 153 is released to become unlocked for movement, the actuator plate 32 is, as a consequence, prevented from being driven by the handle means 15.

As viewed in FIG. 12 the tongue 152 sits within a saddle shaped notch 154 cut out at the top of the slide plate 153.

Figure 15:
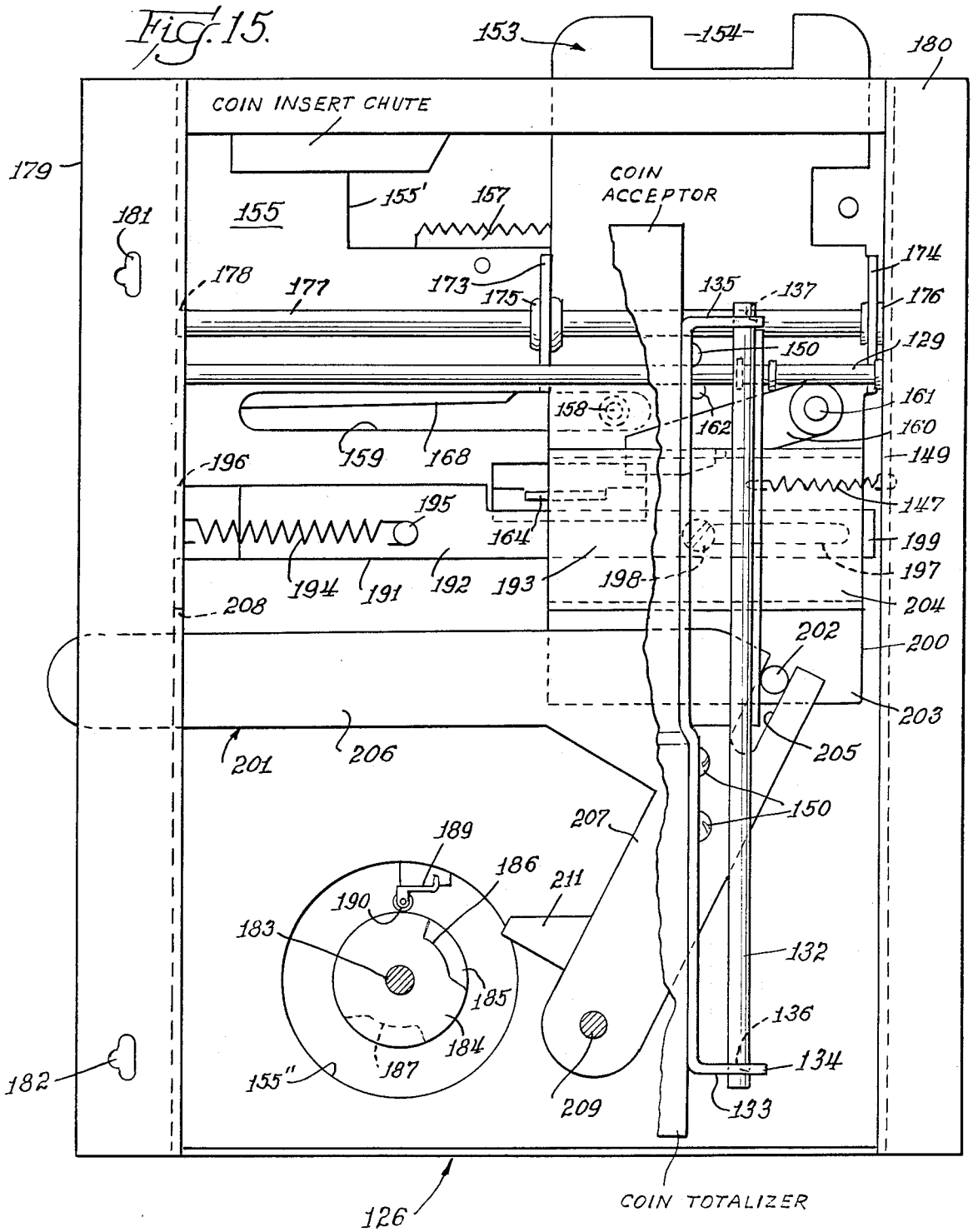
FIG. 15 is a back view of the outer housing assembly for conventional coin acceptor and coin totalizer mechanisms looking generally interiorly thereof wherein the coin acceptor and coin totalizer would be stationed and further showing in greater detail the coin deflector mechanism and the actuator arm means facilitating the opening of the anti-theft sliding trap door.

FIG. 12 shows an outer view of the outer housing 126 and FIG. 15 shows it from the opposite side, or the interior, to be cooperatively arranged adjacent coin acceptor and coin totalizer mechanisms.

The slide plate 153 is slidable relative to a main wall 155 of the housing 126. The slide plate 153 includes a reversing two-way biased pivot dog 156 mounted thereon in relation to a ratchet 157 that is attached along a portion of the bottom edge of an upwardly open rectangular notch 155' which is cutout from the main wall 155. As shown in FIG. 12, the slide plate 153 is locked and is arranged to be movable to the right when unlocked, as will be explained, whereby the reversing pivot dog 156 is dragged across the ratchet 157 and is prevented from leftward movement until the dog passes fully over the right end of the ratchet 157 to be clear thereof. Downwardly spaced from the notch 154, a finger 158 projects outwardly from the slide plate 153 and projects through a slide slot 159 of the main wall 155. A lock pawl 160 carried at the opposite side of the slide plate 153 is pivotally attached at pivot connection 161 to the slide plate 153 and is pivotally stoppable in one direction by a projection 162 projecting from the slide plate 153 from the same side as the lock pawl 160 and adjacent thereto to stop rotation therepast. The lock pawl 160 locks slide plate 153 from being moved due to the downward pivoting position of a lock finger 163 that disposes a horizontal lock finger arm 164 thereof into a sliding path of the lock pawl 160 and thereby prevents the horizontal sliding movement of the slide plate 153. The lock finger 163 is affixed by fasteners 165 to a sensing arm 166 which is pivotally attached at 167 to the main wall 155. The sensing arm 166 includes a flat bottom edge portion 168 that meets a sloped edge 169, which slopes upward to meet an upwardly recessed flat edge portion 170, which in FIG. 12 is spaced generally above the finger 158. When the sensing arm 166 and lock finger 163 are allowed to pivot downwardly in a clockwise direction around the pivot 167, as will be described, the edge portion 170 drops to rest on finger 158, and the lock finger arm 164 moves clear from blocking the path of the lock pawl 160 whereby the slide plate 153 is permitted to move in response to the tongue 152 and thereby carry the pivot dog 156 across the ratchet 157.

With respect to the view in FIG. 12, as the translation to the right is undertaken, the finger 158 moves from the deeper groove defined by the edge portion 170 to travel along the taper 169 and thereby lift the sensing arm 166 to pivot back upwardly until the finger 158 reaches and travels along the flat bottom edge 168. The sliding action is driven by the movement of the tongue 152 as the actuator plate 32 is pulled toward the front support channel 23 by the customer pulling on the handle means 15. The pivot dog 156 is spring biased and rotatable for ratchet engagement in either direction across the ratchet 157 and thereby prevents a reverse movement of the slide plate 153 until the pivot dog 156 clears past the ratchet 157 for both movement to the right during pulling, and movement to the left during pushing while dispensing a copy of the newspaper N at the ejector mechanism 22.

The unlocking of the sensing arm 166 is caused by the vertical dropping of a vertical sensor arm 171 that pivotally attaches to a free end 172 of the lock finger 163. It will be understood that when the slide plate 153 has carried the upstanding finger 158 to the flat bottom edge portion 168 of the sensing arm 166 the lock finger 163 is caused to pivot upwardly thereby moving the vertical sensor arm 171 back upwardly again whereby the lock pawl 160 is then caused to reverse pivot at the pivot connection 161 and drop back to the downward position. Due to its pivoting relationship at the pivot connection 161 the lock finger arm 164 lifts the lock pawl 160 as it moves back to the position in FIG. 12 to pivot up, over and past the lock finger arm 164 during the return push stroke at the handle means 15 in the course dispensing a newspaper N but thereafter the lock finger arm 164 blocks the path of the lock pawl 160 from a return movement to the right, as shown in FIG. 12, until the vertical sensor arm 171 again moves downwardly to unlock the slide plate 153 for a subsequent dispensing of the next newspaper. Thus the lock finger arm 164 serves as a one-way catch for the lock pawl 160.

The slide plate 153 includes inwardly projecting flanges 173 and 174, which are apertured and have bushings at 175 and 176 that are slidably carried upon a horizontal support shaft 177. The support shaft 177 is attached at one end to the outer wall 149 of the housing assembly 126 and at an opposite end to an opposite outer wall 178 of the housing assembly 126. Both the outer walls 149 and 178 are joined to the main wall 155. The housing assembly 126 further includes short elongate flange walls 179 and 180 extending respectively from outer walls 178 and 149 for the attachment to the housing 11 whereby the housing assembly 126 may enclose and supportably accommodate coin accepting and coin totalizing mechanisms. The slide plate 153 is movable from generally adjacent the housing wall 149 when in the locked position to thereafter travel and traverse through the interior of the housing 126 and generally move toward the opposite outer wall 178 along the shaft 177 when unlocked during operation of vending machine 10.

The attachment flange 179 adjacent the outer wall 178 includes a pair of apertures 181 and 182 capable of receiving screw fasteners, for example, for the attachment of the flange 179 to the housing 11.

The unlocking of the vending machine 10 will be understood by those skilled in the vending machine art to be responsive to the unlocking downward motion of the vertical sensor arm 171 in order to release the slide plate 153 and thereby permit the handle means 15 to be pulled outwardly. As stated before, the vending machine 10 is cooperative with conventional coin accepting and coin totalizing means. For illustrative purposes, a standard counting indicating shaft for a price wheel of a coin totalizer is shown at reference numeral 183. As coins of different value are separately received through a coin acceptor mechanism they separately also pass through the coin totalizer which receives them in different paths, such as in three paths, e.g., one each for nickels, dimes and quarters, whereby a trip arm means of a totalizer is mechanically moved as a coin impinges upon it and through known prior art mechanical linkages, the indicating shaft is turned in corresponding increments. For example, a price wheel may include 30 increments such that each would represent a five cent receipt, so that an item of $1.50 might be vended from a particular machine with thirty nickels. A cam wheel is usually provided with such a price wheel and indicating shaft, as at 183, so that a notch thereon moves to a particular orientation at a certain rotation of the shaft 183. At five incremental advances, in the exemplary embodiment, twenty-five cents would have been collected and whereby a cam wheel may be arrangable on the shaft 183 to dispose a notch thereof in an upward position, as is usual, when the full price, in this case twenty-five cents, has been collected. Two such cam wheels are provided at 184 and 185 wherein cam wheel 184 has a notch generally at 186 and cam 185 has a notch at 187. The cam wheels 184 and 185 are attached to the shaft 183, as shown in FIGS. 12 and 15. The outer housing 126 includes a circular access aperture 155" through the main wall 155 wherein the price shaft wheel and cam wheels are exposed whereby to be resettable and monitored when the loading door 12 is opened. The cam wheels 184 and 185 are further provided with standard bosses and engageable serrations 188 so that they may be rotated relative to each other and set in predetermined incremental rotational relationships relative to the shaft 183 for different prices to be indicated and set for each wheel. In FIG. 12, the notch 186 of the cam wheel 184 is shown in dashed lines since it is covered from view by the outer cam wheel 185. At different increments of rotation of the shaft 183 it will be appreciated that the notches 186 and 187 reach the top of the arc of the cam to thereby indicate the different amounts counted by the coin totalizer. When the notch 186 or 187 reaches the top, the vertical sensor arm 171 may be unlocked depending upon which cam wheel movement it is set to sense. An adjustment from one cam wheel to the other for the vertical sensor arm 171 is provided by the invention and will be described hereinafter.

At a lower end, the vertical sensor arm 171 carries a bracket 189 having a rotating cam follower 190 journaled therein. The cam follower 190 rests atop the cam wheel chosen, such as cam wheel 184, along its outer circumference until such time that it is turned to dispose its notch 186 at the topmost position. At this top point, the cam follower 190 will drop into the cam notch 186 thereby causing the vertical sensor arm 171 to drop and unlock the slide plate 153 as explained.

When the slide plate 153 is unlocked the pull-push handle means 15 may be pulled outwardly from the vending machine 10 and thereby pulling the pivot dog 156 of the slide plate 153 across the ratchet 157. During this pulling stroke, two other members arranged with the outer housing assembly 126 are set into motion for the purposes of activating an anti-theft slide door provision. With reference to FIGS. 12, 15 and 17, it will be observed that a spring loaded lockout arm 191 is horizontally arranged with the outer housing assembly 126 and includes a first wide portion 192 and a second narrower portion 193. The narrower portion 193 is provided whereby to afford clearance for the lockout finger arm 164 and lock pawl 160 arranged above and adjacent thereto. A tension spring 194 attaches at one end to a pin 195 on the wider portion 192 and at the other end to the wall 178 to bias the lockout arm 191 outwardly through a slot 196 in the wall 178. The narrower portion 193 includes a slide slot 197 movably arranged over a projecting fastener 198, or the like, projecting inward from the main wall 155, which maintains the lockout arm 191 closely slidable across the wall 155. The narrower portion 193 terminates in a flange 199 that is arranged at a right angle to the lockout arm 191 and is biased by the spring 194 to be pressed against a vertical edge 200 of the slide plate 153, as shown in FIG. 15. When the slide plate 153 is unlocked and pulled by the tongue 152 the tension of the spring 194 urges the lockout arm 191 outwardly through the slot 196 for a purpose which will be hereinafter described with respect to the anti-theft provision of the invention.

The slide plate 153 also drives a flap actuator arm 201 in a pivoting movement. The slide plate 153 includes an upstanding lug 202 formed in a lower flanged portion 203 and generally adjacent a central upstanding plateau portion 204 spaced inward of the main wall 155 which accommodates therebehind, as viewed in FIG. 15, the lockout arm 191, the projecting fastener 198, and portions of the lock finger 163 and pivotally supports the lock pawl 160 at the pivot connection 162 extending therefrom. As the slide plate 153 is pulled responsive to pulling of the handle means 15, the upstanding lug 202 is movably engaged in an elongate slot 205 of the flap actuator arm 201 and moves horizontally with the slide plate 153 to drive the flap actuator arm 201. The flap actuator arm 201 has a longer portion 206 which is joined at an oblique angle to a shorter arm portion 207. The slot 205 is provided generally at the upper portion of the shorter arm 207. A slot 208 in the wall 178 of housing 126 slidably accommodates the longer arm portion 206 therethrough. At a lower portion generally opposite the slot 205, the lower arm 207 is pivotally connected to a freely rotatable shaft 209 extending from the coin totalizer. The shaft 209 is conventionally provided by the manufacturer's of coin totalizers whereby the buyer of the device may adapt it for a particular use in a vending machine. It is located usually adjacent a reset apparatus of the totalizer whereby the lower arm 207 may be arranged with a pivotally engaged reset arm 210 on shaft 209, which includes a reset finger 211 for moving against a reset lever (not shown) of the reset apparatus, also not shown, for coin totalizers as are well known in the art. The reset arm 210 is pivotal with the flap actuator shorter arm 207 and is spring biased at 212 so that the flap actuator arm 201 may be rotated whereby to move the finger 211 to reset the coin totalizer and wherein the spring biasing provides compensation in the event there is an overthrow during the rotation of the flap actuator arm 201. In this regard the reset arm 210 includes a circular engagement flange bracket 213 slidably accommodated within generally square-shaped notch 214 of the lower arm 207 whereby the reset arm 210 may resiliently slide over the shorter arm 207 to compensate for overthrow and prevent damage to a reset apparatus.

The purpose of the flap actuator arm 201 and lockout arm 191 is to control the operation of an inner slidable trap door 215 movably supported at an inner wall frame 216 inward of the loading door 12. The inner slidable trap door 215 is generally a flat rectangular plate and is spaced back from the access outlet 16 at which the pivotal weatherproof door means 17 is located. When the correct number of coins has been inserted and the slide plate 153 is unlocked, as explained, the handle means 15 is pulled whereby the lockout arm 191 under spring biasing moves with the slide plate 153 and the flap actuator arm is rotated at 209 by the driving engagement of the upstanding lug 202 moving horizontally and engaged along slot 205 to thereby rotatingly drive the long arm 206 of the flap actuator 201 through the slot 208 of the housing 126. The illustration in FIG. 17 shows the trap door 215 open and moved downwardly after pulling the handle means 15 to expose the access outlet 16 prior to pushing the handle means 15 to eject a newspaper N. The trap door 15 has one side engaged in slidable relationship to a bracket 217 that is attached to the inner wall frame 216. At the opposite side, the trap door 215 is affixed to a movable elongate L-shaped bracket 218 whereby it will be apparent from the illustrative embodiment that the slidable trap door 215 slides relative to the bracket 217 and is carried by the bracket 218. The bracket 218 includes a pair of elongate slot 219 and 220 that slidingly engage with a pair of upstanding projections 221 and 222, which extend from a side wall portion 223 of the inner wall frame 216. A portion of the bracket 218 includes ratchet teeth 224. A pivotable lock bracket 225, shown in detail in FIGS. 18 and 19, includes a flat plate portion 226 that is pivotally attached at pivot connection 227 to the wall 223, and a flange 228 normal to plate portion 226, which includes an obliquely bent narrower flange 229. The bent narrower portion 229 forms a shoulder 230, which is an engageable catch portion of the bracket providing a ratchet catch against the ratchet teeth 224. The lockout arm 191 is arranged to project outwardly from housing assembly 226 to abut the oblique flange 229 and pivot the pivotable lock bracket 225 out of engagement with the ratchet teeth 224 as the handle means 15 is pulled out to thereby unlock the door 215. The contemporaneous movement of the flap actuator arm 201 brings its long arm 206 outwardly through the slot 208 and downwardly from the outer housing 126 to abut atop an actuator bracket 231, which in the preferred embodiment is an L-shaped member attached to the sliding bracket 218. The flap actuator arm 201 drives the actuator bracket 231 downwardly against tension force biasing the trap door 215 upwardly that is created by a tension spring 232, which is attached at one end to a pin 233 extending from the sidewall 223 and at an opposite end to the actuator bracket 231 for urging it upward.

As the bracket 218 moves downwardly, the access opening 16 becomes exposed since the inner trap door 215 slides downwardly therefrom. During the opening, the lockout arm 191 is met by a pivoting door latch plate number 234 carried on the bracket and which is pivoted at 235. The door latch plate 234 is shown in detail in FIG. 20. The latch plate 234 includes a beveled contact edge **236*a* which the lockout arm 191 is wedged against to pivot the latch plate 234 at 235. A spring 238 is attached at one end to the bracket 218 and to an aperture 237 of the latch plate 234, which is bored through an upper portion of the latch plate 234. The bevelled edge 236*a* terminates in a horizontal shoulder edge 236*b* which extends from the beveled edge 236*a*. As the latch plate 234 is moved downwardly the lockout arm 191 reaches the end of the beveled edge 236*a* at which point the latch plate 234 re-pivots to bring the shoulder edge 236*b* below the lockout arm 191 to secure the latch whereupon the slide door 215 is momentarily latched in the open position since the latch plate 234** is stopped from moving upward.

As the handle means 15 is pushed inwardly to dispense a newspaper N, the slide plate 153 is responsively moved in the opposite direction. During this movement of the slide plate 153, firstly, the flap actuator arm 201 is pivoted away from contact with the actuator bracket 231 and momentarily thereafter the lockout arm 191 is drawn horizontally in the opposite direction to move off of shoulder edge **236*b* and thereby release the latch plate 234. At that point, a newspaper N is moving outwardly through the outlet access 16 from the product tray 31 and the biasing spring 232 pulls the movable bracket 218 attached at the actuator bracket 231 and thereby the inner trap door 215 is spring biased upwardly against the undersurface of the dispensing newspaper N. This serves to deter a thief from gaining entrance through the access outlet 16 to the product tray 31** by attempting to reach underneath a dispensing copy of a newspaper N.

When the trailing edge of a newspaper N is moved past the sliding trap door 215, the trap door 215 is immediately brought upwardly all the way to close behind the access outlet 16 due to the tension of the spring 232 whereupon the pivotal lock bracket 225 pivots back by gravity to engage the ratchet teeth 224 and lock the sliding trap door 215.

ADJUSTMENT ASSEMBLY FOR CHANGING VENDING PRICES

The invention is particularly useful for accommodating the changes in prices of newspapers from daily to Sunday editions. However, the invention has application for dispensing other articles of merchandise wherein price changes may be required for different sizes, qualities, and the like, to be dispensed by vending device 10.

Figure 13:
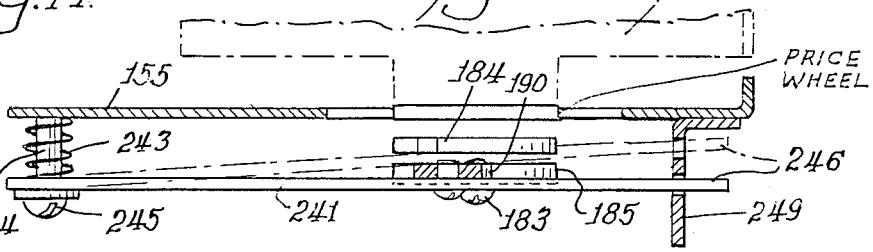
FIG. 13 is a sectional view of FIG. 12 taken along line 13—13 looking in the direction of the arrows and showing the price adjustment arm assembly.

With reference again made to FIGS. 12 and 15 it will be observed that the operation of the vertical sensor arm 171 unlocks the slide plate 153 when it drops into a particular cam notch, such as at 186 or 187 in the illustrative embodiment. As explained, one of the cam wheels 184 and 185 may be set to move to present its notch in the open, or topmost, position at one price incremental rotation of the rotatable shaft 183 and wherein the other cam wheel may move to present its notch in the open, or topmost, position for a different price charged to vend an article. The cam wheels 184 and 185 may be arranged on the shaft 183 by being screw fastened thereon to reach an open position at different total values collected. It has not been known to use two cam wheels or how to provide for an adjustment from one to another. The present invention makes such adjustment possible by providing along the vertical sensor arm 171 a slide slot 239 that extends longitudinally of the vertical sensor arm 171 and therein slidably moves over a slide pin means 240. In the preferred embodiment the pin means 240 comprises a mechanical screw fastener that is connected along a horizontally disposed adjustment arm 241. The pin means 240 is vertically movable within the slide slot 239 and the adjustment arm 241 has a remote end pivotally engaged at 242 to the main wall 155 of the housing 126. The pivotal connection at 242 is best shown in the cross sectional view illustrated in FIG. 13 wherein the adjustment arm 241 is shown to be resiliently biased away from the main wall 155 by a compression spring means 243 biasing the arm 241 with the shank of a fastener 244 that holds the adjustment arm 241 to be spring biased by means of a washer and fastener connector 245. The provision of the slide slot 239 and pin means 240 permits the vertical sensor arm 171 to freely drop into a cam notch 186 or 187, unimpeded by the adjustment arm 241. Thus it will be seen that when the cam notch 186, for example, is in the topmost, or open, position the cam follower 190 will drop into the notch 186 and allows the vertical sensor arm 171 to drop down by means of the slide slot 239 sliding down along the pin means 240.

Figure 14:
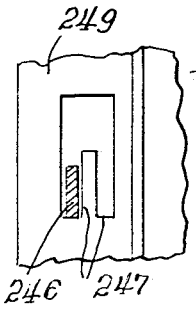
FIG. 14 is a sectional view of FIG. 12 taken along line 14—14 looking in the direction of the arrows and showing a slot in the housing having a dual position for adjusting from one price to another.

The adjustment arm 241 extends outwardly of the wall 178 of the housing assembly 126 and terminates in an end portion at 246. The end portion 246 is supported in a double-slot opening 247 formed through an outward flanged wall 249 which extends from the main wall 155, as shown in FIG. 14. This arrangement allows the delivery driver to simply lift the end portion 246 of the adjustment arm 241 from one slot to the other whereby to change the location of the cam follower 190 from one cam wheel to another, as best viewed in FIG. 13, by virtue of each of the double slots at 247 aligning with one of the cam wheels 184 and 185 in each position, as would be understood. To hold down the adjustment arm 241 from inadvertent upward disengagement, a spring 248 resiliently connects the adjustment arm 241 to the flanged wall 249 to bias the adjustment arm 241 downwardly. Accordingly, depending upon the cam wheel chosen, a different price setting may be obtained by switching from one slot in the double-slot 247 to the other, such as would be useful in changing from daily to Sunday edition sales of newspapers.

COOPERATIVE INTERACTION OF THE VENDING DEVICE SYSTEM

It will thus be apparent that a plurality of cooperative activities and mechanisms are provided for the vending device 10. Upon the dropping of the vertical sensor arm 171 to unlock the slide plate 153 and associated pivoting dog 156 and ratchet 157, the vending device 10 is unlocked and ready for the pull-push handle means 15 to be pulled outwardly by virtue of the actuator plate 32 being movable with the released slide plate 153. The ejector system 22 is operable whereby the ejector plate 53 is moved into position for withdrawing a newspaper N, or the equivalent article of merchandise. The product tray 31 is spring biased upwardly and is controlled by a self-adjusting brake lock mechanism 65 to consistently place a subsequent newspaper with its upper surface adjacent the ejector plate 53 for removal thereby. The spring loaded cable and pulley system 66 provides the upward advancing force in an elevator-like operation controlled by the brake lock mechanism 65. As the pull-push handle means 15 is pushed by the consumer a lockout arm 191 and flap actuator arm 201 are cooperative with an inner sliding trap door 215 to achieve the anti-theft and anti-vandalsim provisions of the invention by maintaining the trap door 215 into biased contact against the undersurface of the newspaper N as it is being dispensed through the access outlet 16 of the housing 11. The lockout arm 191 and flap actuator arm 201 are controlled in operation by the driving force of the slide plate 153 and the cooperative effort of the outer housing assembly 126 associated with coin acceptor and totalizer mechanisms of known construction.

Upon the removal of the last newspaper N from the product tray 31, a coin deflector assembly 125 is activated whereby subsequent coins are returned to the customer through the return slot of the coin acceptor. Upon the need for replenishing the product tray 51 with a new load of articles of merchandise, a lockout safety adjustment 115 is provided whereby the spring loaded product tray 31 may be incrementally loaded downwardly and safely locked at intermittent vertical orientations whereby to allow the delivery truck person to utilize both hands freely and to provide for an efficient controlled means for loading the product tray 31 in stages.

An adjustment arm 241 is cooperative with the cam wheels 184 and 185 and which extends outwardly of the outer housing assembly 126 whereby when the loading door 12 is opened during loading, the vending device 10 may be changed to a different coin value total required to cause the vertical sensor arm 171 to drop to the unlocked position. This is particularly beneficial for delivery truck drivers in changing the prices from daily paper prices to the more expensive Sunday editions.

While the foregoing describes a preferred embodiment for the invention, it is not intended to be limited thereto and it is envisioned that a wide scope of equivalents fall within the ambit of the appended claims.

What is claimed is:

1. Apparatus for dispensing and vending articles one at a time from a stack of articles, which comprises:

a tray for holding a plurality of articles having generally flat upper surfaces;

roller means rotatably connected to said tray;

channel frame means having channels capable of movably accommodating said roller means;

means for spring biasing said tray upwardly;

upper frame means above the tray and supported by said channel frame means;

an ejector shaft supported by said upper frame means;

a reciprocating ejector bracket rotatably and slidably mounted on said ejector shaft, said ejector bracket carrying means for engaging the generally flat upper surface of an article held on said tray;

an actuator means for transmitting reciprocating driving force to said ejector bracket, the actuator means having a pivot bracket mounted to the upper frame means, the pivot bracket pivotally supporting an actuating arm in between ends thereof and wherein at one end of the actuating arm an actuating link is pivotally attached to the ejector bracket and a second actuating link is pivotally attached at the opposite end of the actuating arm whereby to be movable in the opposite direction of the first said actuating link whereby both actuating links have pivotal attachments to the actuating arm;

handle means slidingly engaged with said upper frame means and being mechanically linked to the second actuating link of said actuator means, said handle means being manually movable relative to said upper frame means whereby to drive said actuator means to reciprocate said ejector bracket;

brake lock means for locking the spring biasing means between reciprocations of the ejector bracket said brake lock means including means for sensing the thickness of an article to be dispensed whereby to arrange the generally flat upper surface of a next sequential article into engageable relation with said means for engaging an article carried by said ejector bracket for the sequential dispensing of the next article;

a housing for said apparatus having door means for dispensing articles therethrough, opening means for said handle means to project outward of the housing and a coin slot means;

wherein the paper tray includes a coin lock bracket mounted thereto and movable in a path therewith and coin accepting and totalizing means includes means defining coin pathways and coin return slot, and further comprising a coin deflector plate means having fingers movable into said coin pathways, the coin deflector plate pivotally mounted to a pivot means, a longitudinal sliding rod means being engaged at one end to said coin deflector plate means and having an opposite end thereof positioned in the path of the coin lock bracket whereby to movingly contact said sliding rod means at a predetermined position of said tray to thereby pivot the pivot means and pivot thereby said coin deflector fingers into the coin pathways to deflect coins to the coin return slot whereby said coin lock bracket may thereby be arranged on said tray so that upon the dispensing of a last article thereon, the sliding rod means may be moved whereby to deflect coins from entering said coin accepting and totalizing means after the last article to be dispensed;

means locking said actuator means from movement until the correct amount of coins is inserted; and means for sensing the amount of coins inserted into said coin accepting and totalizing means, and at a present value the sensing means being movable from a first to a second position and unlocking the actuator means permitting the means for engaging an article carried by the ejector bracket to engage and dispense a single article, and upon the reciprocation of the ejector bracket said sensing means being movable to said first position to re-lock said ejector bracket.

* * * * *